United States Patent [19]

Baker

[11] 4,389,739

[45] Jun. 28, 1983

[54] AUTOMATED SURGE WEIR AND RIM SKIMMING GUTTER FLOW CONTROL SYSTEM

[76] Inventor: William H. Baker, 30 Honeysuckle Woods, Clover, S.C. 29710

[21] Appl. No.: 249,248

[22] Filed: Mar. 30, 1981

[51] Int. Cl.[3] ..... E04H 3/16; E04H 3/20

[52] U.S. Cl. ..... 4/512; 4/508; 4/510; 4/511; 210/105; 210/169

[58] Field of Search ..... 4/510, 507, 506, 511, 4/512; 210/169, 104, 102, 105, 126, 123

[56] References Cited

U.S. PATENT DOCUMENTS

| | | | |
|---|---|---|---|
| 1,800,378 | 4/1931 | Everson | 4/512 X |
| 2,809,752 | 10/1957 | Leslie | 4/508 |
| 3,386,107 | 6/1968 | Whitten | 4/508 |
| 3,537,111 | 11/1970 | Whitten | 4/508 |
| 3,668,713 | 6/1972 | Baker | 4/512 |
| 3,668,714 | 6/1972 | Baker | 4/510 |
| 3,739,405 | 6/1975 | Schmidt | 4/508 |
| 3,815,160 | 6/1974 | Baker | 4/510 |
| 3,848,627 | 11/1974 | Page | 4/508 |
| 3,895,402 | 7/1975 | Page | 4/509 X |
| 3,908,207 | 9/1975 | van den Broek | 4/510 |
| 4,050,104 | 9/1977 | Baker | 4/510 |
| 4,080,670 | 3/1978 | van den Broek | 4/510 |
| 4,133,058 | 1/1979 | Baker | 5/510 X |
| 4,173,799 | 11/1979 | Patterson | 4/510 |
| 4,206,522 | 6/1980 | Baker | 4/512 |

*Primary Examiner*—Henry K. Artis

[57] ABSTRACT

An automated skimming flow perimeter gutter control system for swimming pools is provided having a water cleaning and recirculation system receiving water from the pool, cleaning it, and returning it to the pool; a gutter conduit for disposition about the perimeter of a swimming pool, receiving overflow across a top edge thereof and adapted to carry water at a level below a predetermined level in the swimming pool; a drain line connecting the gutter conduit with the water recirculation system; suction means in series flow connection with the gutter conduit and drain line for positive withdrawal under suction of water from the gutter conduit and feed of such water to the water recirculation system for return to the pool; at least one of (a) means for controlling water recirculation capacity to accommodate any selected flow of water from the gutter to the water recirculation system; and (b) means for controlling suction flow from the gutter to the water recirculation system; and at least one water level-responsive sensor sensing and directly responding to the level of water in the gutter conduit by adjusting at least one of the means controlling water recirculation capacity to accommodate flow from the gutter and the means for controlling suction flow, to increase gutter drain flow sufficiently to prevent gutter water flooding back from the gutter to the pool.

64 Claims, 8 Drawing Figures

AUTOMATED SURGE WEIR AND RIM SKIMMING GUTTER FLOW CONTROL SYSTEM

Automatic control at all times of the water level in a pool requires prompt response to changes in operating conditions, and is not easy to achieve. Many attempts have been made, but a fully automated response to all use conditions has not in fact been obtained.

Establishment and maintenance of the water level in a pool when the pool is quiescent is relatively easy. One system for automatically maintaining pool level, sensing pool level by a float in a surge and level control tank, and feeding make-up water to the pool by a float-operated valve, is described in U.S. Pat. No. 3,386,107 to G. R. Whitten Jr., patented June 4, 1968. It is desirable of course to avoid placing a float directly in the pool, since not only would a float be in the way of swimmers, but the float would also be subject to changes in water level due to wave action. These problems are avoided by placing the float in a separate surge and level control tank, connected to the pool below the surface, so that the control responds only to static pool level. When the static level is below a predetermined level, make-up water is added even though the pool surface may be turbulent. In the system of this patent, the make-up water is added to the control chamber in the tank, in which the float sinks to detect a low water level, and excess water is also withdrawn by overflow or drain provided through the control tank. However, as noted by Whitten Jr. in a later U.S. Pat. No. 3,537,111 patented Nov. 3, 1970, the cost of such an elaborate surge and level control tank adds substantially to the total construction cost of the pool.

A further system noted by Whitten Jr. in U.S. Pat. No. 3,537,111 is to provide a sump separated from the pool by a ledge which sets a level for overflow, and a make-up water supply valve feeding directly into the sump under the control of a float. A drain valve is connected to the same float for draining the sump to a recirculating pump whenever the sump tends to overfill. However, this system does not correct flooding of the sump to the pool level by rain or overfilling, and no peripheral gutter is provided in this system, which also requires the construction of a separate sump tank which has to be placed at pool side, rather than located remotely at a location which would be both more convenient and less obstructive of the deck around the pool.

Accordingly, in U.S. Pat. No. 3,537,111, patented Nov. 3, 1970, Whitten Jr. proposed a modified system in which all water level sensors sense water level in the drainage gutter, and not in the pool. The level of drainage flow in the single peripheral gutter is detected at one level or a range of levels. The gutter has an overflow lip or weir for skimming flow at the desired pool height, and delivers overflow to a recirculating pump and filter, which may also draw water from drains under the pool surface. The detecting means controls a valve in a make-up water supply line which either feeds the pool directly, or feeds the recirculating pump, if prefiltration is desired. The control is arranged to open the make-up valve, if the drainage flow falls below a level that will guarantee maintenance of continuous overflow all around the periphery of the pool, taking the provision of a hydraulic gradient in the gutter into account. If the drainage flow rises beyond a normal operating level, which is sufficiently lower than the gutter lip to allow ample space in the gutter to receive abnormal flow caused by pool surge, the control closes the make-up valve and discontinues the supply to the pool.

Means is also provided for increasing the rate of drainage of the gutter under flooding conditions, detecting the level of the drainage flow to control the main drain valve. The control is arranged to partially close the main drain valve to reduce the proportion of the recirculating flow which is drawn from the main drain whenever the gutter flow substantially fills the gutter space reserved for surge and approaches the level of the overflow drain pipe. The effect of this is to increase the rate of flow taken by the recirculating pump from the gutter, and thus hasten a drop in the drainage overflow in the gutter to a suitable operating level. As this level returns to normal, the control reopens the main drain valve to restore the original proportioning of the recirculating flow taken from the gutter and the pool.

The system does however have an inadequate gutter capacity to respond to high gutter flooding conditions.

Higher than normal pool levels, substantially higher than the overflow lip of the gutter, must be prevented from entering the gutter therefore, by covering the gutter with a grille having drain holes whose total area is calculated to admit only the maximum recirculation flow rate that can be handled by the gutter. Such water is retained on the grille, and accordingly washes back to the pool without entering the gutter, which is undesirable, since this washes dirt and debris collected on the grille back into the pool, and accordingly fails to meet modern health code requirements.

In order to prevent this, it is necessary to provide a gutter system of considerably increased capacity, such as a double gutter of the type provided, for example, by U.S. Pat. Nos. 3,668,712, 3,668,713, 3,668,714 and 3,815,160 to Baker. However, the control system of No. 3,537,111 is not suitable for use in a double gutter pool.

U.S. Pat. No. 4,133,058 to Willian H. Baker, patented Jan. 9, 1979 provides a fully automated pool level and skimming gutter flow control system for swimming pools, automatically establishing and controlling pool level and skimming gutter flow under both normal and extraordinary pool use conditions, sensing changes in water level and water activity, and actuating appropriate response mechanisms controlling water feed and skimming gutter drain flow, as well as make-up water and rate of recirculation of the water between the pool and the filtration system. The system comprises a gutter receiving overflow, including surge flow and/or skimming flow, across the top of the perimeter gutter and adequate for normal and surge flow conditions, and optionally, a second gutter receiving skimming flow and also providing additional gutter capacity for extraordinary overflow, including relief flow from the first gutter in the event of considerable activity in the pool, in combination with a level-sensing pool and overflow control system operating from the level of water in the pool and from the level of water in the pool overflow, such as in the gutter conduit, or in a balance tank or a vacuum filter tank, to control the skimming flow and water recirculation between the pool and the gutter, and feed from a water-make-up supply.

U.S. Pat. No. 4,133,059 to William H. Baker patented Jan. 9, 1979, provides a fully automated surge weir and rim skimming gutter flow control system for swimming pools, automatically establishing and controlling surge weir and rim skimming gutter flow under both normal and extraordinary pool use conditions, sensing changes in water level and water activity, and actuating appropriate response mechanisms controlling surge weir and rim skimming gutter flow and/or rate of recirculation of the water between the pool and the filtration system, with switches to convert the gutter from weir skimming and back.

U.S. Pat. No. 4,206,522 to William H. Baker, patented June 10, 1980, provides an automated skimming flow perimeter gutter control system for swimming pools having a water cleaning and recirculation system receiving water from the pool, cleaning it, and returning it to the pool; a first drain line connecting the pool to the water recirculation system for water feed from the pool for cleaning; a gutter conduit for disposition about the perimeter of a swimming pool, receiving overflow across a top edge thereof and adapted to carry water at a level below a predetermined level in the swimming pool; a second drain line connecting the gutter conduit with the water recirculation system for water feed from the gutter for cleaning; skimming means receiving skimming flow across a top edge thereof at the perimeter of the swimming pool; a first drain valve in the first drain line which when open allows water from the pool to flow to the water recirculation system, and when closed stops such flow; a balance means in flow connection with the first and second drain lines and the water recirculation system, receiving pool water via each drain line, blending the pool waters, and flowing the blended waters to the water recirculation system; and at least one water level-responsive sensor sensing and directly responding to the level of water in the balance means and adjusting the water recirculation flow from the pool and from the gutter to increase water recirculation system capacity for flow from the gutter and prevent gutter water flooding back from the gutter to the pool.

U.S. Pat. No. 4,121,307 to James A. Patterson, patented Oct. 24, 1978, provides a perimeter gutter system for a swimming pool including an open gutter around its perimeter including a back wall, a bottom and an inner wall, and a suction pipe extending around the perimeter of the pool at the bottom of the gutter connected to the suction side of a pump for positive withdrawal of water from the gutter.

U.S. Pat. Nos. 4,112,526 to James A. Patterson, patented Sept. 12, 1978, and 4,173,799 to James A. Patterson, patented Nov. 13, 1979, provide a perimeter gutter system for swimming pools comprising a gutter formed in part by an inner lip. Openings spaced around the perimeter of the pool are formed in the inner lip, and means are provided to close the openings when the water level in the gutter reaches a predetermined level. Optionally, a conduit is located below the gutter and is connected to the suction side of a pump. Selectively closeable holes in a wall common to the gutter and conduit form a communication between the conduit and gutter.

In all three of these Patterson gutter designs, the gutter drain has a constant flow rate for feed back to the water recirculation system. Once gutter level is established by a certain flow into the gutter, from overflow through the skimmers or over the peripheral pool retaining wall, and a fixed suction rate via the drain to the pump of the recirculation system, any increase in flow into the gutter increases the gutter level. As activity in the pool increases, therefore, flooding of the gutter is inevitable at some high pool activity level, and at any level of activity above quiescence, the gutter level is always above the level at quiescence, reducing its capacity and increasing its tendency to flood as activity increases further.

The present invention overcomes this flooding problem by providing means for controlling water recirculation capacity to accommodate an increased gutter flow, and means for controlling suction flow from the gutter to the water recirculation system as pool activity increases, so as to be able to draw down gutter water level as pool activity increases to accommodate any above normal gutter flow that may be encountered.

The automated skimming flow perimeter gutter control system for swimming pools thus provided comprises, in combination, a water cleaning and recirculation system receiving water from the pool, cleaning it, and returning it to the pool; a gutter conduit for disposition about the perimeter of a swimming pool, receiving overflow across a top edge thereof and adapted to carry water at a level below a predetermined level in the swimming pool; a drain line connecting the gutter conduit with the water recirculation system; suction means in series flow connection with the gutter conduit and drain line for positive withdrawal under suction of water from the gutter conduit and of such water feed to the water recirculation system for return to the pool; at least one of (a) means for controlling water recirculation capacity to accommodate any selected flow of water from the gutter to the water recirculation system; and (b) means for controlling suction flow from the gutter to the water recirculation system; and at least one water level-responsive sensor sensing and directly responding to the level of water in the gutter conduit by adjusting at least one of the means controlling the water recirculation capacity to accommodate flow from the gutter and the means for controlling suction flow, to increase gutter drain flow sufficiently to prevent gutter water flooding back from the gutter to the pool.

A preferred embodiment of automated skimming flow perimeter gutter control system for swimming pools comprises a perimeter gutter receiving overflow, including surge flow and/or rim skimming flow, across the top of the perimeter gutter and adequate for normal and surge flow conditions, and optionally, one or both of a skimming weir and a second gutter receiving skimming flow, the second gutter also providing additional gutter capacity for extraordinary overflow, including relief flow from the first gutter in the event of considerable activity in the pool, in combination with suction means for withdrawing water from one of the gutters and feeding it to the water recirculation system, and a level-sensing gutter flow control system operating from the level of water in the gutter to control flow between the gutter and the water recirculation system, and optionally, in addition, water feed from a water make-up supply.

Another preferred embodiment of automated skimming flow perimeter gutter control system comprises a water cleaning and recirculation system receiving water from the pool, cleaning it, and returning it to the pool; a first drain line connecting the pool to the water recirculation system for water feed from the pool for cleaning; a gutter conduit for disposition about the perimeter of a swimming pool, receiving overflow across a top edge thereof and adapted to carry water at a level below a predetermined level in the swimming pool; a second drain line connecting the gutter conduit with the water recirculation system; suction means in series flow connection with the gutter conduit and second drain line for positive withdrawal of water from the gutter conduit and water feed from the gutter to the water recirculation system; skimming means affording skimming flow across a top edge thereof at the perimeter of the swimming pool; a first drain valve in the first drain line which when open allows water from the pool to flow to the water recirculation system, and when closed stops such flow; a second drain valve in the second drain line which when open allows water from the gutter to flow to the water recirculation system and when closed stops such flow; and at least one water level-responsive sensor sensing and directly responding to the level of water in the gutter conduit and adjusting the water recirculation flow from the pool and from the gutter to increase water recirculation system capacity for flow from the gutter and to increase suction flow from the gutter so as to prevent gutter water flooding back from the gutter to the pool.

The gutter water level in this system is determined by the total of the skimming and surge flow into the gutter and the gutter drain flow capacity, which in turn is a function of the withdrawal flow rate applied by the suction means, so that gutter water level is in effect a reflection of the stage of pool activity then in being.

Thus, the flow control syste of this invention accommodates any increase in pool activity above the quiescent condition that results in a greater-than-normal skimming flow through the skimming weirs and/or over the rim into the gutter, and that in turn causes the pool water overflow level in the gutter to rise.

The means for controlling water recirculation capacity and the means for controlling suction flow can be the same or different. In some instances, such as at an early pool activity stage, if the water recirculation capacity is already adequate, all that is required to prevent gutter water flooding back from the gutter to the pool is an adjustment of the means for controlling suction flow. Thus, for example, the means for controlling suction flow to increase gutter flow can be a throttling valve in the line between the gutter and the water recirculation system, and this valve can normally be set at less than full suction flow capacity for that line. Then the suction flow can be increased merely by opening the valve further, and this can be done by way of a water-level responsive sensor.

The means for controlling water recirculation capacity can take the form of a throttling valve, which is set at a position that is less than fully open for normal recirculation flow, and then opened further to increase water recirculation flow, as required. This valve can also be controlled by one or more water-level responsive sensors, for one or more degrees of opening.

Water recirculation capacity can also be increased by opening a bypass line bypassing the filter, which also can be controlled by a shut-off valve responsive to a water-level responsive sensor. The pump in the water recirculation line can also be operable at varying speeds, and the speed of pumping increased or decreased, as controlled by one or several water-level responsive sensors to increase or decrease water recirculation capacity and/or suction flow as required.

Another way of increasing water recirculation capacity is to provide two gutter drain lines, one leading to the water recirculation system before the filter, and in normal use, and one for use only in times of high gutter flow, bypassing the filter and returning the gutter drain flow directly to the pool via the water feed line of the water recirculation system. The latter can have a sensor-controlled valve that is normally closed, but opened whenever gutter water level reaches a predetermined high level. Either or both gutter drain lines can be provided with a pump, to apply suction to withdraw suction gutter flow from the gutter, and recirculate it to the pool.

If the pool is provided with a pool drain line also feeding into the water recirculation system, this line can be provided with a throttling valve, and a water-level responsive sensor put in operating connection with this valve. When a selected gutter water level is reached, the water recirculation system capacity for gutter flow can be increased by throttling back or closing the pool drain valve, increasing the recirculation system capacity correspondingly for suction flow into the system from the gutter.

Other variations will become apparent from the disclosure and the embodiments of the invention shown in the drawings.

In the event the gutter system includes one or more surge weirs, arranged in weir passages, an overflow sensor can be provided responsive to a gutter water level corresponding to a selected low or high activity pool condition, in either case above the normal surge weir skimming flow level (which can be sensed in the pool by a pool sensor). When the pool overflow level reaches the level of this gutter sensor, the sensor actuates a mechanism closing off the surge weirs, arresting skimming flow through the weirs, and retaining the water in the pool at a higher level, but allowing skimming flow and/or flow surges to proceed across the top rim of the pool perimeter, into the gutter.

A further increase in pool activity to a higher level corresponding to moderate pool activity will increase the gutter water level. If a two-gutter system is provided, the water level in the first gutter will eventually reach the flooding level, and thus an overflow connection is provided between the first and second gutters, so that such water instead of flooding the first gutter and returning to the pool flows from the first gutter to the second gutter.

In the event provision is made to increase or decrease water recirculation flow according to pool activity, a response is provided when pool activity is moderate.

Under moderate pool activity, there is more water overflow, and this overflow taxes the normal water recirculation system, which may receive flow not only from the gutter but also from the main drain in the pool. Consequently, the gutter water level rises, until it encounters at a predetermined gutter water level a sensor which controls the position of a recirculating flow throttling control valve on the gutter drain line of the recirculation system. This valve can at normal quiescent or light pool activity provide a normal gutter drain suction flow, but upon demand, at moderate or heavy pool activity, the valve can be actuated by the second sensor to provide a higher gutter drain suction flow. The throttling valve thus makes it possible to design the gutter drain system to accommodate any excess flow above the normal gutter drain rate, as may be required according to the amount of pool activity to be expected, or the amount of skimming flow through any weirs and/or across the top of the perimeter rim.

Alternatively, or in addition, this sensor can be put in operating connection with the main drain valve, and when this water level is reached, the water recirculation system capacity for gutter flow can be increased by closing off the main drain valve, causing all recirculation water between the pool and the pool recirculation system to flow into the system from the gutter.

If the gutter drain throttling control valve were not opened, or if the main drain were not cut off, the recirculation system would be unable to accommodate the increased gutter overflow, and the overflow would begin to back up in the gutter system. Consequently, this sensor prevents flooding of the gutters and backwash to the pool under the increased overflow, as a result of this higher level of activity.

Upon a further increase in pool activity, to the maximum, i.e., operation of the pool at the rim flow level, providing skimming flow across the top of the gutter, the amount of overflow into the gutter increases still further. Eventually, such activity raises the gutter water level and again the needed gutter drain flow exceeds to the capacity of the recirculation system to that this drain flow must be increased further, to prevent gutter flooding and wash-back. At this point, an overflow sensor is actuated which further increases recirculating flow, either by opening a recirculating flow throttling control valve on the return line of the recirculation system, to increase the amount of water drawn through the filter, and/or by opening the gutter drain valve (if not opened previously) and/or by opening a bypass line to bypass the filter, so as to permit the recirculation system to accommodate the excess gutter overflow generated under such conditions.

An optional feature is control of normal pool water level. For this purpose two sensors are provided. A gutter overflow sensor senses a level of water in the gutter corresponding to a predetermined below-normal skimming flow, and when this level is reached, opens a make-up valve controlling feed of fresh water from a suply or the water main. An pool sensor senses the level of the water in the pool, and is arranged to close the make-up water valve whenever the pool water level reaches a predetermined normal quiescent level at which skimming flow via surge weirs or a skimming gutter proceeds, and overflows into the gutter. This equilibrium condition continues while skimming flow remains at a rate corresponding to a quiescent pool condition.

The several sensors can be double-acting, i.e., actuated at their predetermined water level, whether that level is reached by a declining flow or by a rising flow, or single-acting, in which case one set of sensors responds to rising level and a second set of sensors can be used if desired responding to declining flow, or a combination of both. Consequently, a declining flow can be made to reverse the sequence of actuation response noted above.

Accordingly, the control system in accordance with the invention makes it possible automatically to accommodate any amount of pool activity without gutter flooding or washing back of debris and contaminants in the gutters into the pool, permitting skimming flow through surge weirs and/or over the perimeter rim, as may be desired.

One embodiment of automated pool perimeter skimming gutter water level control system of the invention comprises, in combination, a gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit; at least one surge weir disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flow, wave actions and surges up to a predetermined minimum, while allowing excessive flows, wave actions and surges beyond such minimum to flow over the top of the wall into the gutter conduit; a water cleaning and recirculating system for collecting water from the pool and water flowing into and along the gutter conduit, cleaning it, and returning it to the pool; a drain line connecting the gutter conduit with the water recirculation system; suction means in series flow connection with the gutter conduit and drain line for positive withdrawal under suction of water from the gutter conduit and feed of such water to the water recirculation system for return to the pool; means for controlling water recirculation capacity to accommodate any selected flow of water from the gutter to the water recirculation system; means for controlling suction flow from the gutter to the water recirculation system; and an overflow sensor sensing a water level in the gutter overflow characteristic of a selected degree of pool activity, corresponding to excessive weir skimming flow, and arranged to close at least one weir.

Another embodiment of automated pool perimeter skimming gutter water level control system of the invention comprises, in combination, a gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit, the top rim of the wall being placed at a height to maintain a predetermined water level in the pool, to provide a skimming flow of water at such predetermined water level in the pool, and to allow excessive flows, wave actions and surges to flow over the top rim of the wall into the gutter conduit; a water cleaning and recirculating system for collecting water from the pool and water flowing into and along the gutter conduit, cleaning it, and returning it to the pool; a drain line connecting the gutter conduit with the water recirculation system; suction means in series flow connection with the gutter conduit and drain line for positive withdrawal under suction of water from the gutter conduit and feed of such water to the water recirculation system for return to the pool; means for controlling water recirculation capacity to accommodate any selected flow of water from the gutter to the water recirculation system; means for controlling suction flow from the gutter to the water recirculation system; and an overflow sensor sensing a gutter overflow level characteristic of an above-normal skimming flow and corresponding to a level of pool activity above a normal quiescent pool condition, and arranged to increase water recirculation system capacity to accommodate such increased overflow, and prevent wash-back from a gutter conduit to the pool.

Another embodiment of automated pool perimeter skimming gutter water level control system of the invention comprises, in combination, a gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit; at least one surge weir disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flow, wave actions and surges up to a predetermined minimum, while allowing excessive flows, wave actions and surges to flow over the top rim of the wall into the gutter conduit; a water cleaning and recirculating system for collecting water from the pool and water flowing into and along the gutter conduit, cleaning it, and returning it to the pool; a drain line connecting the gutter conduit with the water recirculation system; suction means in series flow connection with the gutter conduit and drain line for positive withdrawal under suction of water from the gutter conduit and feed of such water to the water recirculation system for return to the pool; means for controlling water recirculation capacity to accommodate any selected flow of water from the gutter to the water recirculation system; means for controlling suction flow from the gutter to the water recirculation system; and an overflow sensor sensing a gutter overflow level characteristic of an above-normal skimming flow and corresponding to a level of pool activity above a normal quiescent pool condition, and arranged to increase gutter suction drain flow to accommodate such increased overflow, and prevent wash-back from a gutter conduit to the pool.

To avoid the restriction of a limited flow through a filter, a bypass line can be incorporated to allow some or all such excess flow to bypass the filter.

A further embodiment of automated pool perimeter skimming gutter water level control system of the invention comprises, in combination, a gutter conduit for disposition about the perimeter of swimming pool, and adapted to carry water at a level below a predetermined level of water in the swimming pool; a retaining wall on the pool side of the gutter conduit, over the top rim of which wall water may flow from the pool into the gutter conduit, the top rim of the wall being placed at a height to maintain a predetermined water level in the pool, to provide a skimming flow of water over the top rim at such predetermined water level in the pool, and to allow excessive flows, wave actions and surges to flow over the top rim of the wall into the gutter conduit; a water cleaning and recirculating system for collecting water from the pool and water flowing into and along the gutter conduit, cleaning it, and returning it to the pool; and including a water recirculation throttling valve controlling the capacity for recirculating water flow of the water cleaning and recirculating system, a drain line connecting the gutter conduit with the water recirculation system; suction means in series flow connection with the gutter conduit and drain line for positive withdrawal under suction of water from the gutter conduit and feed of such water to the water recirculation system for return to the pool; means for controlling water recirculation capacity to accommodate any selected flow of water from the gutter to the water recirculation system; means for controlling suction flow from the gutter to the water recirculation system; and an overflow sensor sensing a higher level in the gutter overflow downstream of the pool characteristic of an above-normal water flow, wave action and surges into the gutter conduit, and arranged to adjust the water recirculation throttling valve to increase recirculation system capacity to accommodate such increased overflow, and prevent wash-back from a gutter conduit to the pool.

A preferred embodiment of twin-gutter automated pool perimeter skimming gutter water level control system of the invention comprises, in combination, a first gutter conduit for disposition about the perimeter of a swimming pool, and adapted to carry water at a level below a predetermined level of water in the swimming pool; a second gutter conduit for disposition about the perimeter of a swimming pool, and adapted to carrry water at a level below a predetermined level of water in the swimming pool; a retaining wall on the pool side of the gutter conduit, over the top rim of which wall water may flow from the pool into a gutter conduit; the top rim of the wall being placed at a height to maintain a predetermined water level in the pool, to provide a skimming flow of water at such predetermined water level in the pool, and to allow excessive flows, wave actions and surges to flow over the top rim of the wall into a gutter conduit; a water cleaning and recirculating system for collecting water from the pool and water flowing into and along the first and second gutter conduits, cleaning it, and returning it to the pool; a drain line connecting the gutter conduit with the water recirculation system; suction means in series flow connection with the gutter conduit and drain line for positive withdrawal under suction of water from the gutter conduit and feed of such water to the water recirculation system for return to the pool; means for controlling water recirculation capacity to accommodate any selected flow of water from the gutter to the water recirculation system; means for controlling suction flow from the gutter to the water recirculation system; and an overflow sensor sensing a water level in the gutter overflow downstream of the pool characteristic of a high degree of water flow, wave action and surges into the gutter conduit, and arranged to increase water recirculation system capacity to recirculate such increased overflow and prevent wash-back from a gutter conduit to the pool.

Another embodiment of twin-gutter automated pool perimeter skimming gutter water level control system of the invention comprises, in combination, a first gutter conduit for disposition about the perimeter of a swimming pool, and adapted to carry water at a level below a predetermined level of water in the swimming pool; a retaining wall on the pool side of the first gutter conduit, over the top rim of which wall water may flow from the pool into the first gutter conduit; a second gutter conduit for disposition about the perimeter of a swimming pool, and adapted to carry water at a level below a predetermined level of water in the swimming pool; the top rim of the wall being placed at a height to maintain a predetermined water level in the pool, to provide a skimming flow of water over the top rim of the wall at such predetermined water level in the pool, and allow excessive flows, wave actions and surges to flow over the top rim of the wall into the first gutter conduit; a water cleaning and recirculating system for collecting water from the pool and water flowing into and along the first and second gutter conduits, cleaning it, and returning it to the pool; a drain line connecting the gutter conduit with the water recirculation system; suction means in series flow connection with the gutter conduit and drain line for positive withdrawal under suction of water from the gutter conduit and feed of such water to the water recirculation system for return to the pool; means for controlling water recirculation capacity to accommodate any selected flow of water from the gutter to the water recirculation system; means for controlling suction flow from the gutter to the water recirculation system; and an overflow sensor sensing a water level in the gutter overflow downstream of the pool characteristic of a high degree of water flow, wave action and surges into the first gutter conduit, and arranged to increase gutter suction drain flow to accommodate such increased overflow, and prevent wash-back from a gutter to the pool.

Another embodiment of automated pool perimeter skimming gutter water level control system of the invention comprises, in combination, a first gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit; a second gutter conduit for disposition about the perimeter of a swimming pool, and adapted to carry water at a level below a predetermined level of water in the swimming pool; at least one surge weir disposed through the retaining wall below the top thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top rim of the wall into the first gutter conduit; a water cleaning and recirculating system for collecting water from the pool and water flowing into and along the first and second gutter conduits, cleaning it, and returning it to the pool, a drain line connecting the gutter conduit with the water recirculation system; suction means in series flow connection with the gutter conduit and drain line for positive withdrawal under suction of water from the gutter conduit and feed of such water to the water recirculation system for return to the pool; means for controlling water recirculation capacity to accommodate any selected flow of water from the gutter to the water recirculation system; means for controlling suction flow from the gutter to the water recirculation system; and an overflow sensor sensing a water level in the gutter overflow downstream of the pool characteristic of a low threshold of pool activity but excessive weir skimming flow, and arranged to close at least one weir.

Another embodiment of twin-gutter automated pool perimeter skimming gutter water level control system of the invention comprises, in combination, a first gutter conduit for disposition about the perimeter of a swimming pool, and adapted to carry water at a level below a predetermined level of water in the swimming pool; a retaining wall on the pool side of the first gutter conduit, over the top rim of which wall water may flow from the pool into the first gutter conduit; a second gutter conduit for disposition about the perimeter of a swimming pool, and adapted to carry water at a level below a predetermined level of water in the swimming pool; at least one surge weir disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top rim of the wall into the first gutter conduit; a water cleaning and recirculating system for collecting water from the pool and water flowing into and along the first and second gutter conduits, cleaning it, and returning it to the pool; a drain line connecting the gutter conduit with the water recirculation system; suction means in series flow connection with the gutter conduit and drain line for positive withdrawal under suction of water from the gutter conduit and feed of such water to the water recirculation system for return to the pool; means for controlling water recirculation capacity to accommodate any selected flow of water from the gutter to the water recirculation system; means for controlling suction flow from the gutter to the water recirculation system; a first gutter sensor sensing a first water level in a gutter characteristic of a low threshold of pool activity but excessive weir skimming flow, and arranged to close at least one weir; and a second gutter sensor sensing a second higher level in the second gutter characteristic of a high degree of water flow, wave action and surges into the first gutter conduit, and arranged to increase water recirculation system capacity to recirculate such increased gutter flow and prevent wash-back from a gutter conduit to the pool.

Another embodiment of automated pool perimeter skimming gutter water level control system of the invention comprises, in combination, a first gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit; a second gutter conduit for disposition about the perimeter of a swimming pool, and adapted to carry water at a level below a predetermined level of water in the swimming pool; at least one surge weir disposed through the retaining wall below the top rim thereof, at a height to maintain a predetermined water level in the pool; and to provide a skimming flow of water through the weir at such predetermined water level in the pool, the top rim of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top rim of the wall into the first gutter conduit; a water cleaning and recirculating system for collecting water from the pool and water flowing into and along the first and second gutter conduits, cleaning it, and returning it to the pool; and including a water recirculation throttling valve controlling the capacity for recirculating water flow of the water cleaning and recirculating system; a drain line connecting the gutter conduit with the water recirculation system; suction means in series flow connection with the gutter conduit and drain line for positive withdrawal under suction of water from the gutter conduit and feed of such water to the water recirculation system for return to the pool; means for controlling water recirculation capacity to accommodate any selected flow of water from the gutter to the water recirculation system; means for controlling suction flow from the gutter to the water recirculation system; a first sensor sensing a first water level in the second gutter characteristic of a low threshold of pool activity but excessive weir skimming flow, and arranged to close at least one weir; and a second sensor sensing a second higher level in the second gutter characteristic of a high degree of water flow, wave action and surges into the first gutter conduit, and arranged to adjust the water recirculation throttling valve to increase water recirculation system capacity to recirculate such increased gutter flow and prevent wash-back from a gutter conduit to the pool.

Another embodiment of automated pool perimeter skimming gutter water level control system of the invention comprises, in combination a gutter conduit for disposition about the perimeter of a swimming pool, and adapted to carry water at a level below a predetermined level of water in the swimming pool; a retaining wall on the pool side of the gutter conduit, over the top of which wall water may flow from the pool into the gutter conduit; at least one surge weir disposed through the retaining wall below the top thereof, at a height to maintain a predetermined water level in the pool, and to provide a skimming flow of water through the weir at such predetermined water level in the pool, the top of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the gutter conduit; a water cleaning and recirculating system for collecting water from the pool and water flowing into and along the gutter conduit, cleaning it, and returning it to the pool; and including a water recirculation throttling valve controlling the capacity for recirculating water flow of the water cleaning and recirculating system; a drain line connecting the gutter conduit with the water recirculation system; suction means in series flow connection with the gutter conduit and drain line for positive withdrawal under suction of water from the gutter conduit and feed of such water to the water recirculation system for return to the pool; means for controlling water recirculation capacity to accommodate any selected flow of water from the gutter to the water recirculation system; means for controlling suction flow from the gutter to the water recirculation system; a first overflow sensor sensing a first water level in the gutter overflow downstream of the pool characteristic of a low threshold of pool activity but excessive weir skimming flow, and arranged to close at least one weir; a second gutter overflow sensor sensing a second higher level in the overflow downstream of the pool characteristic of a high degree of water flow, wave action and surges into the gutter conduit, and arranged to increase water recirculation system capacity to recirculate such increased gutter flow; and a third gutter overflow sensor sensing a third higher level in the overflow downstream of the pool characteristic of a higher degree of water flow, wave action and surges into the gutter conduit; and arranged to adjust the water recirculation throttling valve to increase recirculation system capacity to accommodate such increased overflow, and prevent wash-back from the gutter conduit to the pool.

Another embodiment of twin-gutter automated pool perimeter skimming gutter water level control system of the invention comprises, in combination, a first gutter conduit for disposition about the perimeter of a swimming pool, and adapted to carry water at a level below a predetermined level of water in the swimming pool; a retaining wall on the pool side of the first gutter conduit, over the top of which wall water may flow from the pool into the first gutter conduit; a second gutter conduit for disposition about the perimeter of a swimming pool, and adapted to carry water at a level below a predetermined level of water inthe swimming pool; at least one surge weir disposed through the retaining wall below the top thereof, at a height to maintain a predetermined water level in the pool, and to provide a skimming flow of water through the weir at such predetermined water level in the pool, the top of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the first gutter conduit; a water cleaning and recirculating system for collecting water from the pool and water flowing into and along the first and second gutter conduits, cleaning it, and returning it to the pool; and including a water recirculation throttling valve controlling the capacity for recirculating water flow of the water cleaning and recirculating system; a drain line connecting the gutter conduit with the water recirculation system; suction means in series flow connection with the gutter conduit and drain line for positive withdrawal under suction of water from the gutter conduit and feed of such water to the water recirculation system for return to the pool; means for controlling water recirculation capacity to accommodate any selected flow of water from the gutter to the water recirculation system; means for controlling suction flow from the gutter to the water recirculation system; a first gutter sensor sensing a higher water level in a gutter characteristic of a low threshold of pool activity but excessive weir skimming flow, and arranged to close at least one weir; a second gutter sensor sensing a higher level in a gutter characteristic of a high degree of water flow, wave action and surges into the first gutter conduit, and arranged to increase water recirculation system capacity to recirculate such increased gutter flow to the pool; and a third gutter sensor sensing a higher level in a gutter characteristic of a higher degree of water flow, wave action and surges into the conduit, and arranged to adjust the water recirculation throttling valve to increase recirculation system capacity to accommodate such increased gutter flow, and prevent wash-back from a gutter conduit to the pool.

A further feature of the control system in accordance with the invention is the provision of an overriding control such as an electric switch, to make it possible to operate skimming flow either through weirs or over the perimeter rim, as desired, while retaining any and all other automatic controls, to accommodate any amount of pool activity without gutter flooding or washing back of debris and contaminants in the gutters into the pool, permitting skimming flow through surge weirs and/or over the perimeter rim, as may be desired.

One embodiment of such a pool permiter skimming gutter water level control system of the invention comprises, in combination, a gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit; at least one surge weir disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flow, wave actions and surges up to a predetermined minimum, while allowing excessive flows, wave actions and surges beyond such minimum to flow over the top of the wall into the gutter conduit; a water cleaning and recirculating system for collecting water from the pool and water flowing into and along the gutter conduit, cleaning it, and returning it to the pool; a drain line connecting the gutter conduit with the water recirculation system; suction means in series flow connection with the gutter conduit and drain line for positive withdrawal under suction of water from the gutter conduit and feed of such water to the water recirculation system for return to the pool; means for controlling water recirculation capacity to accommodate any selected flow of water from the gutter to the water recirculation system; means for controlling suction flow from the gutter to the water recirculation system; an overflow sensor sensing a water level in the gutter overflow downstream of the pool characteristic of a low threshold a pool activity, but excessive weir skimming flow, and arranged to close at least one weir; and means overriding the gutter overflow sensor to close the weir and direct all skimming flow over the top rim of the retaining wall.

Another embodiment of such a pool perimeter skimming gutter water level control system of the invention, utilizing a twin-gutter pool perimeter skimming gutter, comprises, in combination, a first gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit; a second gutter conduit for disposition about the perimeter of a swimming pool, and adapted to carry water at a level below a predetermined level of water in the swimming pool; at least one surge weir disposed through the retaining wall below the top thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top rim of the wall into the first gutter conduit; a water cleaning and recirculating system for collecting water from the pool and water flowing into and along the first and second gutter conduits, cleaning it, and returning it to the pool; a drain line connecting the gutter conduit with the water recirculation system; suction means in series flow connection with the gutter conduit and drain line for positive withdrawal under suction of water from the gutter conduit and feed of such water to the water recirculation system for return to the pool; means for controlling water recirculation capacity to accommodate any selected flow of water from the gutter to the water recirculation system; means for controlling suction flow from the gutter to the water recirculation system; a gutter overflow sensor sensing a water level in the gutter overflow downstream of the pool characteristic of a low threshold of pool activity but excessive weir skimming flow, and arranged to close at least one weir; and means overriding the gutter overflow sensor to close the weir and direct all skimming flow over the tip rim of the retaining wall.

Another embodiment of such a twin-gutter pool perimeter skimming gutter water level control system of the invention comprises, in combination, a first gutter conduit for disposition about the perimeter of a swimming pool, and adapted to carry water at a level below a predetermined level of water in the swimming pool; a retaining wall on the pool side of the first gutter conduit, over the top rim of which wall water may flow from the pool into the first gutter conduit; a second gutter conduit for disposition about the perimeter of a swimming pool, and adapted to carry water at a level below a predetermined level of water in the swimming pool; at least one surge weir disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top rim of the wall into the first gutter conduit; a water cleaning and recirculating system for collecting water from the pool and water flowing into and along the first and second gutter conduits, cleaning it, and returning it to the pool; a drain line connecting the gutter conduit with the water recirculation system; suction means in series flow connection with the gutter conduit and drain line for positive withdrawal under suction of water from the gutter conduit and feed of such water to the water recirculation system for return to the pool; means for controlling water recirculation capacity to accommodate any selected flow of water from the gutter to the water recirculation system; means for controlling suction flow from the gutter to the water recirculation system; a first sensor sensing a first water level in a gutter characteristic of a low threshold of pool activity but excessive weir skimming flow, and arranged to close at least one weir; means overriding the first sensor to close the weir and direct all skimming flow over the top rim of the retaining wall; and a second sensor sensing a second higher level in the second gutter characteristic of a high degree of water flow, wave action and surges into the first gutter conduit, and arranged to increase gutter suction drain flow to recirculate such increased gutter flow and prevent wash-back from a gutter conduit to the pool.

Another embodiment of such a twin-gutter pool perimeter skimming gutter water level control system of the invention comprises, in combination, a first gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit; a second gutter conduit for disposition about the perimeter of a swimming pool, and adapted to carry water at a level below a predetermined level of water in the swimming pool; at least one surge weir disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top rim of the wall into the first gutter conduit; a water cleaning and recirculating system for collecting water from the pool and water flowing into and along the first and second gutter conduits, cleaning it, and returning it to the pool; a drain line connecting the gutter conduit with the water recirculation system; suction means in series flow connection with the gutter conduit and drain line for positive withdrawal under suction of water from the gutter conduit and feed of such water to the water recirculation system for return to the pool; means for controlling water recirculation capacity to accommodate any selected flow of water from the gutter to the water recirculation system; means for controlling suction flow from the gutter to the water recirculation system; a first sensor sensing a first water level in the second gutter characteristic of a low threshold of pool activity but excessive weir skimming flow, and arranged to close at least one weir; means overriding the first sensor to close the weir and direct all skimming flow over the top rim of the retaining wall; and a second sensor sensing a second higher level in the second gutter characteristic of a high degree of water flow, wave action and surges into the first gutter conduit, and arranged to increase water recirculation system capacity to recirculate such increased gutter flow and prevent wash-back from a gutter conduit to the pool.

Another embodiment of such a pool perimeter skimming gutter water level control system of the invention comprises, in combination, a gutter conduit for disposition about the perimeter of a swimming pool, and adapted to carry water at a level below a predetermined level of water in the swimming pool; a retaining wall on the pool side of the gutter conduit, over the top of which wall water may flow from the pool into the gutter conduit; at least one surge weir disposed through the retaining wall below the top thereof, at a height to maintain a predetermined water level in the pool, and to provide a skimming flow of water through the weir at such predetermined water level in the pool, the top of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the gutter conduit; a water cleaning and recirculating system for collecting water from the pool and water flowing into and along the gutter conduit, cleaning it, and returning it to the pool; a drain line connecting the gutter conduit with the water recirculation system; suction means in series flow connection with the gutter conduit and drain line for positive withdrawal under suction of water from the gutter conduit and feed of such water to the water recirculation system for return to the pool; means for controlling water recirculation capacity to accommodate any selected flow of water from the gutter to the water recirculation system; means for controlling suction flow from the gutter to the water recirculation system; a first sensor sensing a first water level in the gutter overflow downstream of the pool characteristic of a low threshold of pool activity but excessive weir skimming flow, and arranged to close at least one weir; means overriding the first sensor to close the weir and direct all skimming flow over the top rim of the retaining wall; a second sensor sensing a second higher level in the gutter overflow downstream of the pool characteristic of a high degree of water flow, wave action and surges into the gutter conduit, and arranged to increase water recirculation system capacity to recirculate such increased gutter flow; and a third sensor sensing a third higher level in the gutter overflow downstream of the pool characteristic of a higher degree of water flow, wave action and surges into the gutter conduit; and arranged to increase gutter suction drain flow to accommodate such increased overflow, and prevent wash-back from the gutter conduit to the pool.

Another embodiment of twin-gutter automated pool perimeter skimming gutter water level control system of the invention comprises, in combination, a first gutter conduit for disposition about the perimeter of a swimming pool, and adapted to carry water at a level below a predetermined level of water in the swimming pool; a retaining wall on the pool side of the first gutter conduit, over the top of which wall water may flow from the pool into the first gutter conduit; a second gutter conduit for disposition about the perimeter of a swimming pool, and adapted to carry water at a level below a predetermined level of water in the swimming pool; at least one surge weir disposed through the retaining wall below the top thereof, at a height to maintain a predetermined water level in the pool, and to provide a skimming flow of water through the weir at such predetermined water level in the pool, the top of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the first gutter conduit; a water cleaning and recirculating system for collecting water from the pool and water flowing into and along the first and second gutter conduits, cleaning it, and returning it to the pool; a drain line connecting the gutter conduit with the water recirculation system; suction means in series flow connection with the gutter conduit and drain line for positive withdrawal under suction of water from the gutter conduit and feed of such water to the water recirculation system for return to the pool; means for controlling water recirculation capacity to accommodate any selected flow of water from the gutter to the water recirculation system; means for controlling suction flow from the gutter to the water recirculation system; a first gutter sensor sensing a higher water level in a gutter characteristic of a low threshold of pool activity but excessive weir skimming flow, and arranged to close at least one weir; means overriding the first sensor to close the weir and direct all skimming flow over the top rim of the retaining wall; a second sensor sensing a higher level in a gutter characteristic of a high degree of water flow, wave action and surges into the first gutter conduit, and arranged to increase water recirculation system capacity to recirculate such increased gutter flow to the pool; and a third sensor sensing a higher level in a gutter characteristic of a higher degree of water flow, wave action and surges into the conduit, and arranged to increase gutter suction drain flow to accommodate such increased gutter flow, and prevent wash-back from a gutter conduit to the pool.

The weir or weirs for skimming flow can be skimming slots, as in U.S. Pat. Nos. 3,668,712, and 3,668,714, the slots feeding water directly into the second gutter conduit.

The gutter overflow level can be sensed by overflow sensors at any position related to a gutter water level downstream of the pool, where a gutter water level correlated with pool activity and skimming flow exists, and can be detected. If there be more than one gutter, the second gutter downstream of the first gutter is preferred, but any gutter can be used.

The water level sensing and control system of the invention is applicable to any design of single or multiple gutter perimeter gutter system.

U.S. Pat. No. 3,668,712 to William H. Baker dated June 13, 1972, provides a perimeter skimming gutter for swimming pools including a gutter conduit for disposition about the perimeter of a swimming pool and adapted to carry water at a level below a predetermined level of water in the swimming pool, a retaining wall on the pool-side of the conduit, over the top of which wall water may flow from the pool into the gutter conduit, and a plurality of narrow elongated substantially horizontally disposed openings through the wall at a height to maintain a predetermined water flow, the top of the wall being spaced above the openings at a height to retain the pool water within the pool perimeter at water flows, wave actions and surges up to a predetermined maximum, while allowing excessive water flows, wave actions and surges beyond such maximum to flow over the top of the wall into the gutter conduit.

U.S. Pat. No. 3,668,714 to William H. Baker dated June 13, 1972, provides a nonflooding perimeter skimming gutter for swimming pools including a first gutter conduit for disposition about the perimeter of a swimming pool, and adapted to carry water at a level below a predetermined level of water in the swimming pool, a retaining wall on the pool-side of the first gutter conduit over the top of which wall a skimming flow of water may run from the pool into the first gutter conduit, a second gutter conduit adapted to carry water at a level below a predetermined level of water in the first gutter conduit, and a fluid flow connection between the two gutter conduits at such level and below the top of the retaining wall allowing water flow from the first gutter conduit into the second gutter conduit whenever the water level on the first gutter conduit reaches the fluid flow connection, thereby inhibiting filling of the first gutter conduit appreciably above such level.

Both skimming gutter designs are quite satisfactory for most sizes of swimming pool. If their unusually large gutter capacity can at times be exceeded, then the gutter of U.S. Pat. No. 3,815,160 to William H. Baker, dated June 11, 1974, can be used.

This nonflooding perimeter skimming gutter wall permits an adequate skimming action at all times, and also provides for virtually unlimited surge capacity when the pool is in use, without the possibility of the gutter's flooding, or dirt in the gutter's being washed back into the pool. This is accomplished by combining a second gutter conduit within a peripheral wall of the swimming pool, making available for gutter flow the internal volume of the wall, in fluid flow connection with the first gutter conduit, and adapted to receive water from the first gutter conduit whenever the level of water in that gutter exceeds a predetermined maximum, established at the level of the fluid flow connection therebetween. This fluid flow connection is below the top of the retaining wall, so that the water level in the first gutter conduit cannot reach the top of the retaining wall. The second gutter conduit within the wall is entirely separate from the first, and is designed to provide an ample reserve flow capacity to accommodate any heavy or surge action that may be likely to be encountered. The fluid flow connection between the gutter conduits can be arranged to skim the dirt off the top of the first gutter trough, thus assisting in preventing this dirt from being washed back into the pool.

In this gutter system, the water level in the pool is normally maintained at the level at the top of the retaining wall, which consequently serves as a skimmer gutter at the pool perimeter. The fluid flow connection may constitute a second skimming flow outlet, supplementing and continuing the skimming action of the first.

The term "conduit" as used herein is inclusive of open conduits or troughs as well as partially or wholly enclosed conduits.

In a preferred embodiment of the invention the first gutter conduit is an open trough, with at least one fluid flow connection with the second gutter conduit in the form of one of a plurality of openings at the predetermined maximum level of water in the first gutter conduit.

The second gutter conduit preferably is a closed conduit. The second gutter conduit can be within any peripheral wall of the pool. It can, for example, be within the peripheral pool-side retaining wall. It can also be within a peripheral external wall of the gutter, on the side away from the pool.

In a preferred embodiment of the invention, a water-feed conduit is provided in the gutter for feed of fresh water into the pool. This conduit is preferably an integral part of the nonflooding perimeter skimming gutter, at the pool-side retaining wall, admitting water to the pool through the pool-side retaining wall.

In the case where the two gutters are separated by a common wall, the fluid flow connection between the two gutters can be of any configuration, and is in sufficient number and at a high enough level to provide for an adequate flow capacity, to prevent the water level in the first gutter conduit from appreciably exceeding the height of the overflow connection under any water surge or wave conditions in the pool.

The level of the overflow connections with respect to the bottom of the first gutter conduit can be adjustable, so as to provide adjustment of the water level permitted in the first gutter conduit before flow via the overflow connections into the second gutter conduit commences. This adjustment can be provided for by forming the overflow connections as vertical slots or with an extended vertical height, and disposing a movable barrier member over the overflow connections with the opening or openings of the desired size and shape.

Withdrawal of water from the gutter and feed to the water recirculation system is accomplished by interposing a pump in flow connection with the gutter and drain line therefrom. The pump precedes the filter and any other water cleaning devices, and does not replace the usual pump feeding clean water to the pool.

The provision of suction means requires that the gutter be continuously supplied with skimming water flow by skimming weirs or a perimeter skimming rim or both.

Thus, a suction operated gutter can have the water in the gutter positively withdrawn by connecting it to the low pressure side of a pump to the filter. Skimming weirs provide assurance that the gutter is continuously supplied with water, thus avoiding air entering the pump. Alternatively, a suction evacuated gutter can be used in a pool having no skimming weirs wherein the level of the pool is kept sufficiently high that water continuously overflows the perimeter rim of the gutter wall, to maintain a continuous supply of water into the gutter.

Preferred embodiments of the invention are shown in the drawings, in which.

Figure 1:
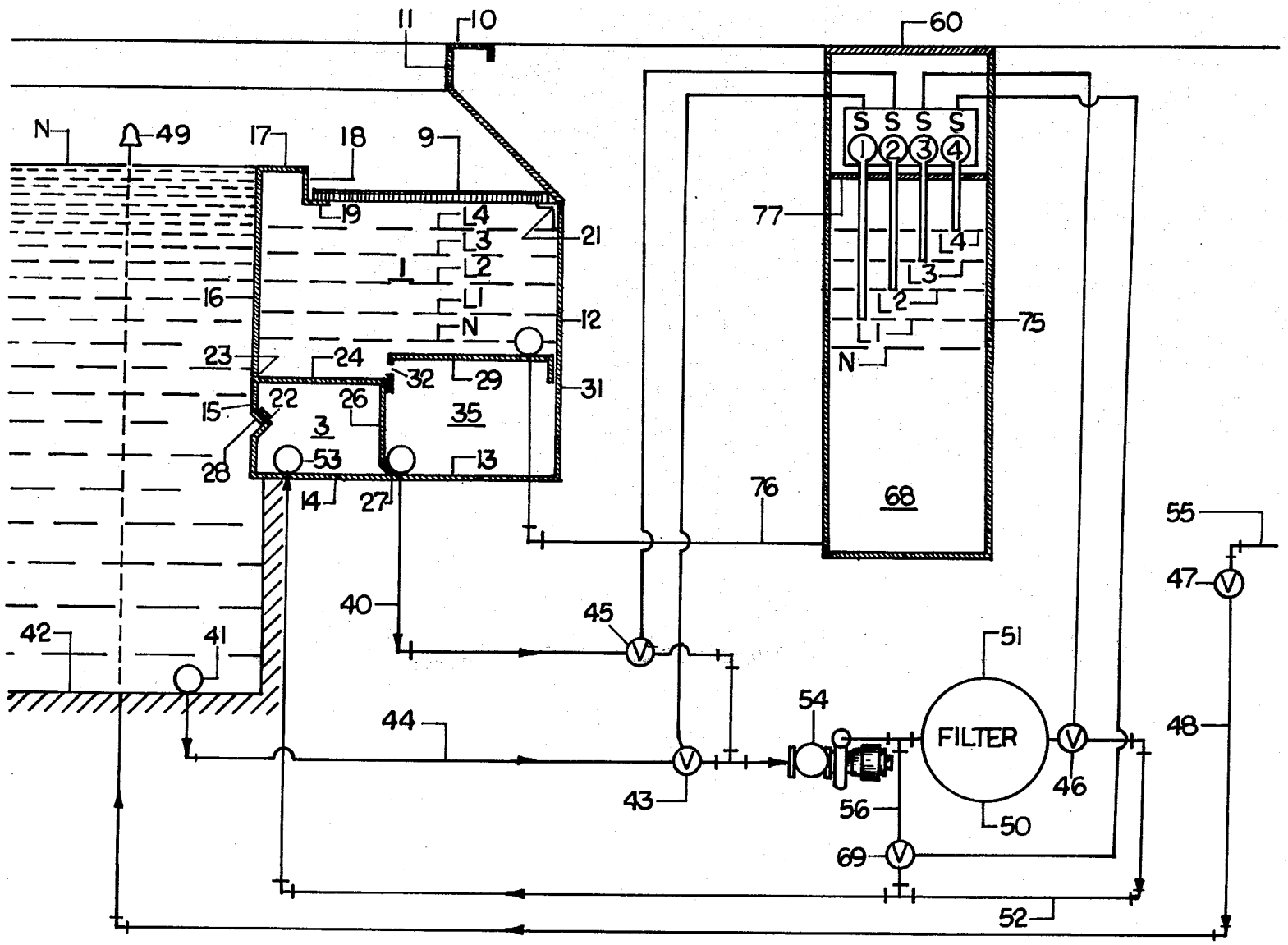
FIG. 1 is a pool water flow circuit diagram, showing a single gutter pool perimeter water recirculation system with a four-sensor automated control system of the invention imposed thereon.
Figure 2:
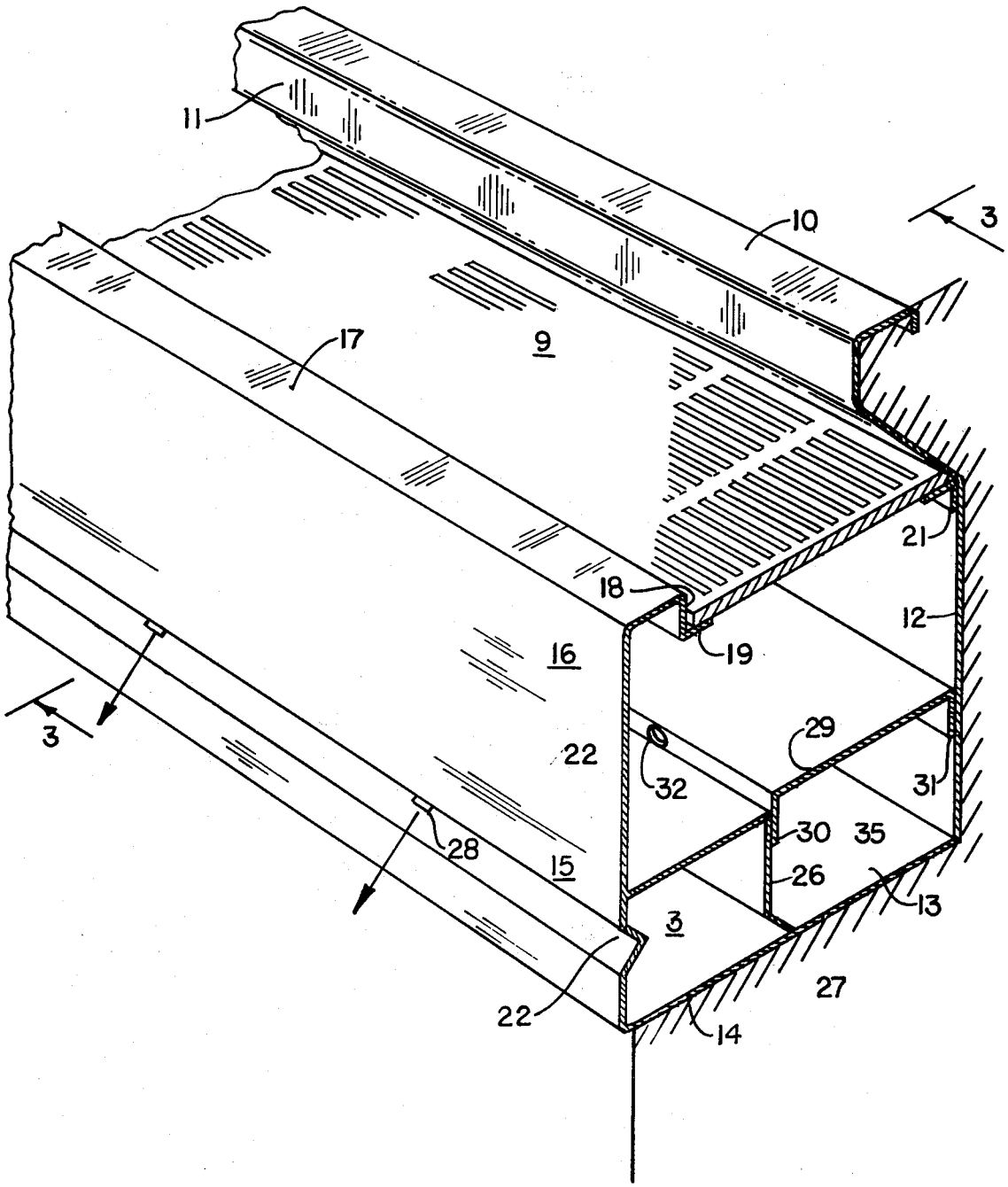
FIG. 2 represents a view of one modular unit of a pool perimeter gutter of FIG. 1.

The pool perimeter single gutter system shown in FIGS. 1 and 2 is made in a plurality of modular units, which are fitted together on-site and bonded together by welding, soldering or brazing in the number required to form the perimeter rim of a swimming pool. A sheet of stainless steel or other corrosion-resistant metal or plastic material is formed in the configuration shown, with a top coping 10, a gutter back wall 11, bent forward towards the pool in a manner to partially cover over the opening into the gutter 1, and then continuing to form back wall 12 and the bottom wall 13 of the gutter 1, the bottom wall 14 and pool perimeter side wall 15 of a water feed conduit 3, the pool perimeter side wall 16 of the gutter 1, and the top wall 17 of the gutter 1, which also serves as the top rim of the swimming pool, over which water may flow into the gutter 1. The stainless steel sheet terminates in a flange 19. A second flange 21 is attached by welding or brazing to the back wall 11 of the gutter 1.

A grille 9 rests on flanges 19,21, and covers over the open top of the gutter 1, so as to prevent bathers from stepping into it, with possibly injurious consequences. The grille is removable and of course can be omitted.

The pool perimeter wall 15 of the water feed conduit 3 has a V-notch 22. At 23 above the V a third sheet of stainless steel is welded, and formed so as to extend inwardly and down to define the other sidewalls 24,26 of the water feed conduit 3, and is welded to the bottom 13 of the gutter 1 at 27.

A plurality of openings 28 are provided in the notch 22 of the pool perimeter wall 15 of the water feed conduit 3, for feed of recirculating clean water to the pool. These openings can, if desired, be provided with nozzles or jets, in known manner, directing flow downwardly into the pool.

There is a wall 29 with openings 32 therethrough welded at one end 30 to the wall 26 and at the other end 31 to the wall 12, forming a suction conduit 35 to draw water from the gutter 1 into the water recirculation system.

There is a gutter drain overflow line connection 40 leading from the conduit 35 to the suction side of the pump 54, which is a part of the recirculation system 50, and there is also a main drain 41 in the bottom 42 of the swimming pool leading via main drain line 44 to the recirculation system. There is a main drain throttling valve 43 in the main drain line 44, so that this line can be closed off, or partially or fully opened, and there is also a gutter drain overflow valve 45 in the gutter line 40, so that this can be closed off, or partially or fully opened. On the downstream side of the filter 51 in the water purifying system there is a two-position recirculation flow throttling valve 46, which controls recirculation flow through the filter and the return feed line 52 leading to the water feed inlet 53 in the conduit 3. The valve 46 also can be partially or fully opened or closed, increasing the recirculating flow or decreasing it, as may be required. There is a bypass line 56 bypassing the filter 51 and there is also a valve 69 in line 56 which can be opened to control flow bypassing the filter. The pump 54 sucks water from the gutter via the gutter drain line 40 from the pool via main drain line 44, and maintains circulation of water through the water recirculation system via the filter 51 and return feed line 52 to the conduit 3.

There is also a make-up water valve 47 in fluid flow connection via a line 48 to the fillspout 49 on the deck of the pool, permitting introduction of fresh water from the water supply, such as, for example, the water main supply at the pool location, via line 55.

The water level sensing system 60, best seen in FIG. 1, is composed of four double-acting sensors, with sensor S1 controlling opening and closing of the main drain throttling valve 43, sensor S2 controlling opening and closing of gutter drain overflow valve 45, sensor S3 controlling opening and closing of the two-position recirculation flow throttling valve 46, as flow increases or diminishes, and sensor S4 controlling opening and closing of bypass valve 69, controlling flow in the line 56 bypassing the filter and connecting with line 52 to the water feed conduit 3.

The four sensors, S1,S2,S3,S4, detect four different water levels in the gutter 1. These water levels are sensed not in the gutter or pool, but in gutter level chamber 68 in the gutter level tank 75 directly connected via line 76 with the gutter 1 at the bottom. The position of these sensors can be adjusted up or down on bracket mounting bar 77, so that any desired combination of selected gutter water levels can be detected, and an appropriate response effected.

Normal pool operating level is represented by gutter level N, with the pool quiescent, and normal skimming flow provided across the top rim 17 into the gutter.

The first gutter sensor S1 senses and responds to a first level L1 of water in the gutter 1, above the normal operating level N, at the first degree of higher pool activity, with more than normal skimming flow cascading across the top rim 17 into the gutter 1, and representing more flow into the gutter than can be accommodated by the suction conduit 35. The sensor responds to this level in the gutter by closing the main drain throttling valve 43, sending an electric signal to the valve, thus making available the full capacity of the pump for suction flow via line 40 from the conduit 35, but this flow is still somewhat restricted by valve 45, which is only partially open.

The second gutter sensor S2 senses a second and higher gutter water level L2, corresponding to the increased flow over the rim 17, under light pool activity. When the water level reaches level L2 the capacity of the conduit 35 has to be further increased. Sensor S2 responds to this condition by actuating the valve 45, and opening it further, to its fully open condition.

A further increase in pool activity to the medium activity level will lead to an increased flow of water across the top 17 of the perimeter gutter into the gutter 1. This increases the water level in the gutter, to the level L3, sensed by the third gutter sensor S3, and increases the burden on the water recirculation system, which requires adjustment to accommodate the increased gutter flow.

Accordingly, this sensor S3 opens the recirculation flow throttling valve 46 to the next higher open position, further increasing the rate (and therefore the volume amount) of recirculation flow through the recirculation system 50, so as to accommodate the increased flow through the gutter.

A further increase in pool activity to the maximum activity level, and/or a blocking in the filter 51, impeding flow, increases gutter level to level L4. This is sensed by sensor S4, which responds by signalling and opening bypass valve 69, and line 56 bypassing the filter. This bypass is so designed as to accommodate any maximum gutter flow that may be encountered during maximum activity in the pool.

As pool activity decreases, and gradually returns to normal, the fourth sensor S4 is actuated, closes valve 69 and bypass line 56, then the third sensor S3 is actuated and thereupon throttle back recirculation flow throttling valve 46, to accommodate normal flow, so that the water recirculation system responds to the now decreased circulation through the gutter.

When the gutter level decreases further, to the level L2, sensor S2 is actuated, and throttles back valve 45, and then at level L1, sensor S1 is actuated, and reopens valve 43. The level then drops to normal level N and this condition is maintained so long as the pool is quiescent, at normal pool operating level, thus ensuring adequate skimming flow during periods of quiescence.

The electric sensors S1, S2, S3, S4 and the actuating electric control circuit are well known, conventional and commercially available. In place of electric sensors, pneumatic or pressure-operated sensors can be used, sensing a water pressure related to water level, and actuating an electric control circuit.

It is thus apparent that this sensor system in accordance with the invention senses and responds to a water level in the gutter, so as to accommodate any volume of overflow as over-rim flow in the gutter, without gutter flooding or spill back into the pool.

The necessary gutter capacity to accommodate the increased gutter flow during periods of pool activity, whether low or intense, is provided by the gutter and the suction drain flow, thus ensuring that at no time does water washed into the gutter return to the pool without having first passed through the pool cleansing and recirculation system via the filter. The response to the higher level of activity is fully automatic in all cases.

The gutter overflow control system is consequently fully automatic, whether the flow to be accommodated is increasing or decreasing, and according to whether the pool is quiescent or active.

Figure 3:
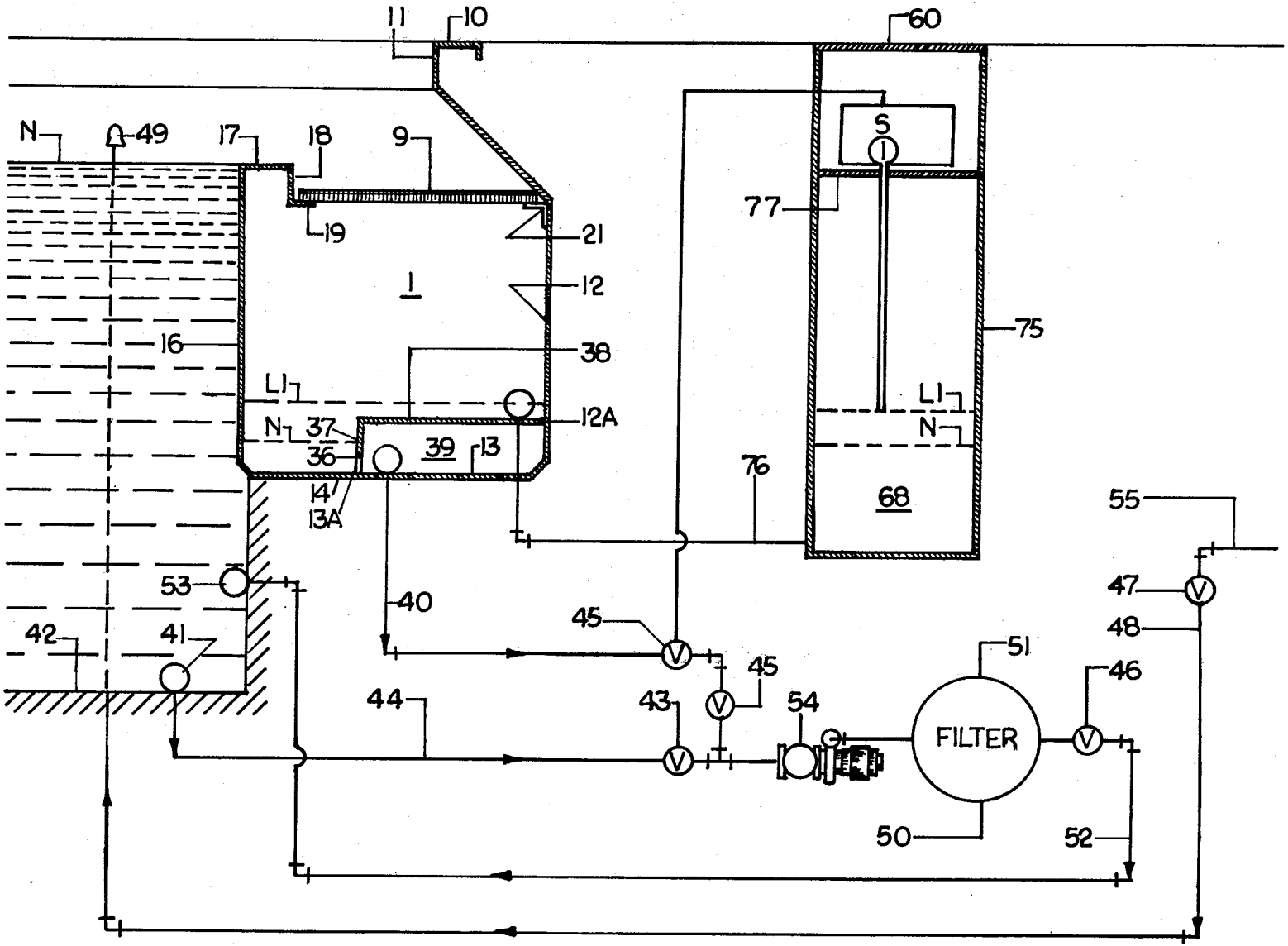
FIG. 3 is a pool water flow circuit diagram similar to that of FIG. 1, but without a perimeter clean water feed line in the gutter.

The pool perimeter single gutter system shown in FIG. 3 is made in a plurality of modular units, which are fitted together on-site and bonded together by welding, soldering or brazing in the number required to form the perimeter rim of a swimming pool. A sheet of stainless steel or other corrosion-resistant metal or plastic material is formed in the configuration shown, with a top coping 10, a gutter back wall 11, bent forward towards the pool in a manner to partially cover over the opening into the gutter 1, and then continuing to form back wall 12 and the bottom wall 13 of the gutter 1, the bottom wall 14 and the pool perimeter side wall 16 of the gutter 1, and the top wall 17 of the gutter 1, which also serves as the top rim of the swimming pool, over which water may flow into the gutter 1. The stainless steel sheet terminates in a flange 19. A second flange 21 is attached by welding or brazing to the back wall 11 of the gutter 1.

A grille 9 rests on flanges 19, 21, and covers over the open top of the gutter 1, so as to prevent bathers from stepping into it, with possibly injurious consequences. The grille is removable and of course can be omitted.

A third sheet of stainless steel having openings 36 therethrough is welded across the bottom 13 of the gutter and formed so as to extend inwardly and downwardly to define the sidewalls 37, 38 of a suction conduit 39 and is welded to the wall 12 of the gutter at 12*a*, and to bottom 13 of the gutter 1 at 13*a*.

There is a direct line connection 40 leading from the gutter suction conduit 39 to the suction side of the pump 54 which is a part of the water recirculation system 50, and there is also a main drain 41 in the bottom 42 of the swimming pool leading via main drain line 44 to the recirculation system. There is a main drain throttling valve 43 in the main drain line 44, so that this line can be closed off, or partially or fully opened, and there is also a gutter drain overflow valve 45 in the gutter line 40, so that this can be closed off, or partially or fully opened. On the upstream side of the filter 51 in the water purifying system there is a recirculation flow throttling valve 46, which controls recirculation flow through the filter and the return feed line 52 leading to the waterspout 47. The valve 46 also can be partially or fully opened, or closed, increasing the recirculating flow or decreasing it, as may be required. The pump 54 maintains suction flow in line 40 from conduit 39 and in line 44 from the pool, and circulation of water through the filter 51 and return feed line 52 to the pool water feed inlet 53.

There is also a make-up water valve 47 in fluid flow connection via the line 48 to the line 52 and fillspout 49 on the deck of the pool, permitting introduction of fresh water from the water supply, such as, for example, the main water supply at the pool location, via line 55.

The water level sensing system 60 is composed of one sensor S1, which is double-acting, detecting the water level L1 in the gutter 1. This water level is sensed not in the gutter but in gutter level chamber 68 of the gutter level tank 75, which is in fluid flow connection by the line 76 to the gutter 1 below level L1. The electric sensor S1 and the actuating electric control circuit are well known, conventional and commercially available. In place of an electric sensor, a pneumatic or pressure-operated sensor can be used, sensing a water pressure related to water level L1, and actuating an electric control circuit. The position of the sensor S1 can be adjusted up or down on bracket mounting bar 77, so that any desired gutter water level can be detected, and an appropriate response effected.

The normal operating level N corresponds to the level when the pool is quiescent, with normal skimming flow provided over the top 17 of the perimeter pool wall 16 into the gutter. The suction flow through line 40 from conduit 39 is sufficient to accommodate this flow.

The gutter sensor S1 senses a higher gutter water level L1, corresponding to the increased perimeter pool overflow under light pool activity. When the water level reaches L1, it is because there is too little suction flow through the line 40, and it is necessary to increase flow to accommodate this higher gutter flow. Sensor S1 responds to this condition by opening valve 45, which increases suction flow so that the line 40 can carry off the higher flow cascading over the top 17 of the perimeter gutter into gutter 1, so that gutter 1 has an adequate capacity to accommodate such flow.

Any and all further increases in pool activity will lead to an increased flow of water across the top 17 of the perimeter gutter into the gutter 1. However, even under maximum pool activity, the flow never fills the gutter 1, since with valve 45 fully open, suction flow from conduit 39 via line 40 is sufficient to accommodate any such increased gutter flow.

It is thus apparent that this sensor system in accordance with the invention senses and responds to a water level in the gutter, so as to accommodate any volume of overflow as over-rim flow into the gutter, without gutter flooding or spill back into the pool.

The necessary gutter capacity to accommodate the increased gutter flow during periods of pool activity, whether low or intense, is provided by the gutter, thus ensuring that at no time does water washed into the gutter return to the pool without having first passed through the pool cleansing and recirculation system via the filter. The response to the higher level of activity is fully automatic in all cases.

As pool activity decreases, the level of water in the gutter gradually returns to level L1, whereupon the sensor S1 is again actuated, and closes down the valve 45 to throttle suction flow to a level corresponding to a quiescent pool at normal pool operating level, i.e. at gutter level N, without sucking the gutter below level N.

The gutter overflow control system is consequently fully automatic, whether the flow to be accommodated is increasing or decreasing, and according to whether the pool is quiescent or active.

Figure 4:
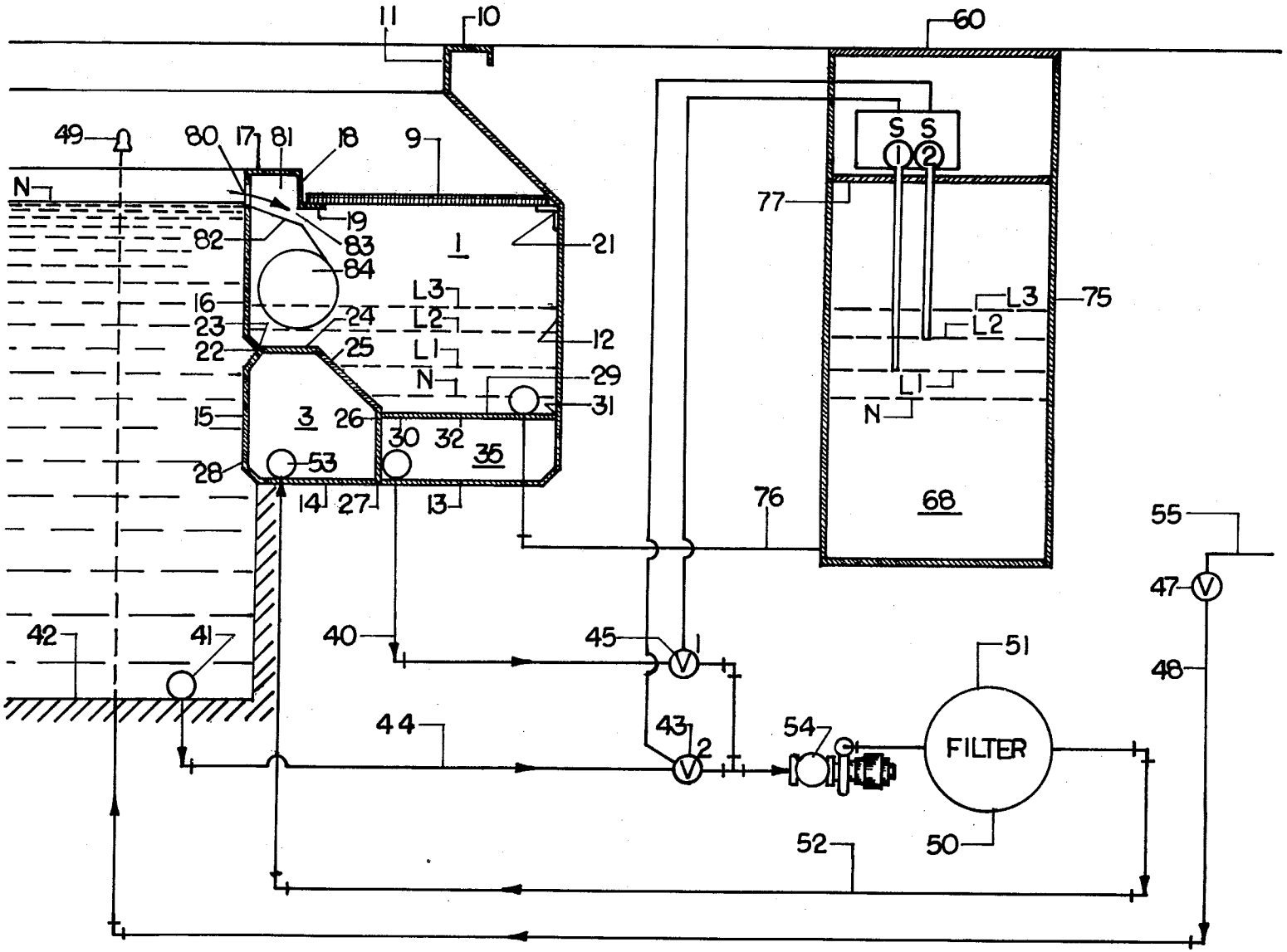
FIG. 4 is a pool water flow circuit diagram of another embodiment of single gutter perimeter water recirculation system, with skimming weirs feeding skimming flow into the gutter.

The pool perimeter single gutter system shown in FIG. 4 is made in a plurality of modular units, which are fitted together on-site and bonded together by welding, soldering or brazing in the number required to form the perimeter rim of a swimming pool. A sheet of stainless steel or other corrosion-resistant metal or plastic material is formed in the configuration shown, with a top coping 10, a gutter back wall 11, bent forward towards the pool in a manner to partially cover over the opening into the gutter 1, and then continuing to form back wall 12 and the bottom wall 13 of the gutter 1, the bottom wall 14 and pool perimeter side wall 15 of a water feed conduit 3, the pool perimeter side wall 16 of the gutter 1, and the top wall 17 of the gutter 1, which also serves as the top rim of the swimming pool, over which water may flow into the gutter 1. The stainless steel sheet terminates in a flange 19. A second flange 21 is attached by welding or brazing to the back wall 11 of the gutter 1.

A grille 9 rests on flanges 19, 21, and covers over the open top of the gutter 1, so as to prevent bathers from stepping into it, with possibly injurious consequences. The grille is removable and of course can be omitted.

Through the pool perimeter side wall 16 of the gutter are a number of narrow, long openings 80, approximately one-half inch below the top rim 17 of the gutter 1. These openings lead to weir passages 81, which accommodate skimming flow from the pool, and feed it directly into the gutter 1. Surge flow across the top 17 of the perimeter gutter also feeds directly into the gutter 1. Flaps 82 are provided across the openings 83 at the inner ends of the weir passages 81. These flaps are pivotally mounted at their poolside end, and are attached at their gutter-side end to floats 84, which rise and fall on the level of water in the gutter 1. At levels corresponding to L2 and below, the flaps are open. At level L3 and above, the flaps and so the weirs are closed, automatically, closing off the weir passages 81. The opening and closing of the flaps can be effected by any kind of mechanism, however.

The pool perimeter walls 16 of the gutter 1 and 15 of the water feed conduit 3 meet in a V-notch 22. At the base 23 of the V a third sheet of stainless steel is welded, and formed so as to extend inwardly and down to define the other sidewalls 24,25,26 of the water feed conduit 3, and is welded to the bottom 13 of the gutter 1 at 27.

A plurality of openings 28 are provided in the pool perimeter wall 15 of the water feed conduit 3, for feed of recirculating clean water to the pool. These openings can, if desired, be provided with nozzles or jets, in known manner, directing flow horizontally or downwardly into the pool.

A fourth sheet of stainless steel 29 having a plurality of openings 32 extends between wall 26 of conduit 3 and wall 12 of the gutter, welded at 30 to wall 26, and at 31 to wall 12, defining a suction conduit 35. There is a direct gutter drain line connection 40 leading from the conduit 35 to the suction side of pump 54, which is a part of the water recirculation system 50, and there is also a main drain 41 in the bottom 42 of the swimming pool leading via main drain line 44 to the recirculation system. There is a main drain throttling valve 43 in the main drain line 44, so that this line can be closed off, or partially or fully opened, and there is also a gutter drain overflow valve 45 in the gutter drain line 40, so that this can be closed off, or partially or fully opened. The pump 54 sucks water from the gutter 1 via openings 32 and conduit 35 and line 40, and from the pool via line 44, and maintains circulation of water through the filter 51 and return feed line 52 to the conduit 3.

There is also a make-up water valve 47 in fluid flow connection via a line 48 to the fillspout 49 or the deck of the pool, permitting introduction of fresh water from the water supply, such as, for example, the water main supply at the pool location, via line 55.

The water level sensing system 60 is composed of two sensors S1, S2 which are double-acting, detecting two different water levels L1, L2 in the gutter 1. These water levels are sensed not in the gutter, but in gutter level chamber 68 in the gutter level tank 75 in direct fluid flow connection by the line 76 to the gutter 1. The electric sensors S1, S2, and the actuating electric control circuit are well known, conventional and commercially available. In place of electric sensors, pneumatic or pressure-operated sensors can be used, sensing a water pressure related to water level, and actuating an electric control circuit. The gutter sensors S1,S2 each respond to a different level L1, L2 of water in the gutter. The position of these sensors can be adjusted up or down on bracket mounting bar 77, so that any desired two gutter water levels can be detected, and an appropriate response effected.

The normal operating level N corresponds to the level when the pool is quiescent, with the surge weir passages 81 open, and normal skimming flow provided through the surge weir passages via openings 80 into the gutter. The surge weir flaps 82 are open, in the position shown in FIG. 4.

The first gutter sensor S1 senses a higher gutter water level L1, corresponding to the increased surge weir flow under light pool activity. When the water level reaches L1, it is because there is too much flow through the weirs, and it is necessary to increase suction flow through line 40. Sensor S1 responds to this condition by actuating the valve 45, opening it to its fully open position. In this condition, some surge flow cascades over the top 17 of the perimeter gutter into gutter 1, but gutter 1 and suction drain line 40 have an adequate capacity to accommodate such flow.

Any and all further increases in pool activity will lead to an increased flow of water across the top 17 of the perimeter gutter into the gutter 1. When the level of water reaches level L2, this means that the pump 54 and the line 52 have inadequate capacity to handle the load, so that sensor S2 is activated, and in turn sends an electric signal to valve 43, closing it, shutting off the main drain line 44 from the pool, and thus allowing the total water circulation system capacity to accommodate this amount of water via line 40.

When the level of water reaches level L3, this means that the flow capacity of the water recirculation system has been reached, and so the floats 83 close off the surge weirs, thereby reducing flow into the gutter, limiting this inflow to flow over the top rim 17 at maximum or near maximum pool activity. However, even under maximum pool activity, the flow never fills the gutter 1, which with suction flow via conduit 35 and line 40 has adequate capacity to accommodate any such gutter flow.

It is thus apparent that this sensor system in accordance with the invention senses and responds to a water level in the gutter, so as to close off the weirs, and also to accommodate maximum overflow as over-rim flow into the gutter, without gutter flooding or spill back into the pool.

The necessary gutter capacity to accommodate the increased gutter flow during periods of pool activity, whether low or intense, is provided by the gutter, thus ensuring that at no time does water washed into the gutter return to the pool without having first passed through the pool cleansing and recirculation system via the filter. The response to the higher level of activity is fully automatic in all cases.

As pool activity decreases, and gradually returns to normal, so does gutter level, and at level L3 the surge weirs open automatically while at levels L2 and L1 the sensor are again actuated in the same order, but in reverse sequence, so that the water recirculation system responds to the now decreased circulation through the gutter.

Thus, a decrease in the gutter level to level L2 actuates sensor S2, which reopens valve 43 to normal pool drain flow. Decrease in gutter level to level L1 actuates sensor S1, which closes back valve 45 to normal gutter drain flow in line 40, and this condition is maintained as long as the pool is quiescent, at normal pool operating level, i.e., at gutter level N.

The surge weir control system is consequently fully automatic, whether the flow to be accommodated is increasing or decreasing, and according to whether the pool is quiescent or active.

Figure 5:
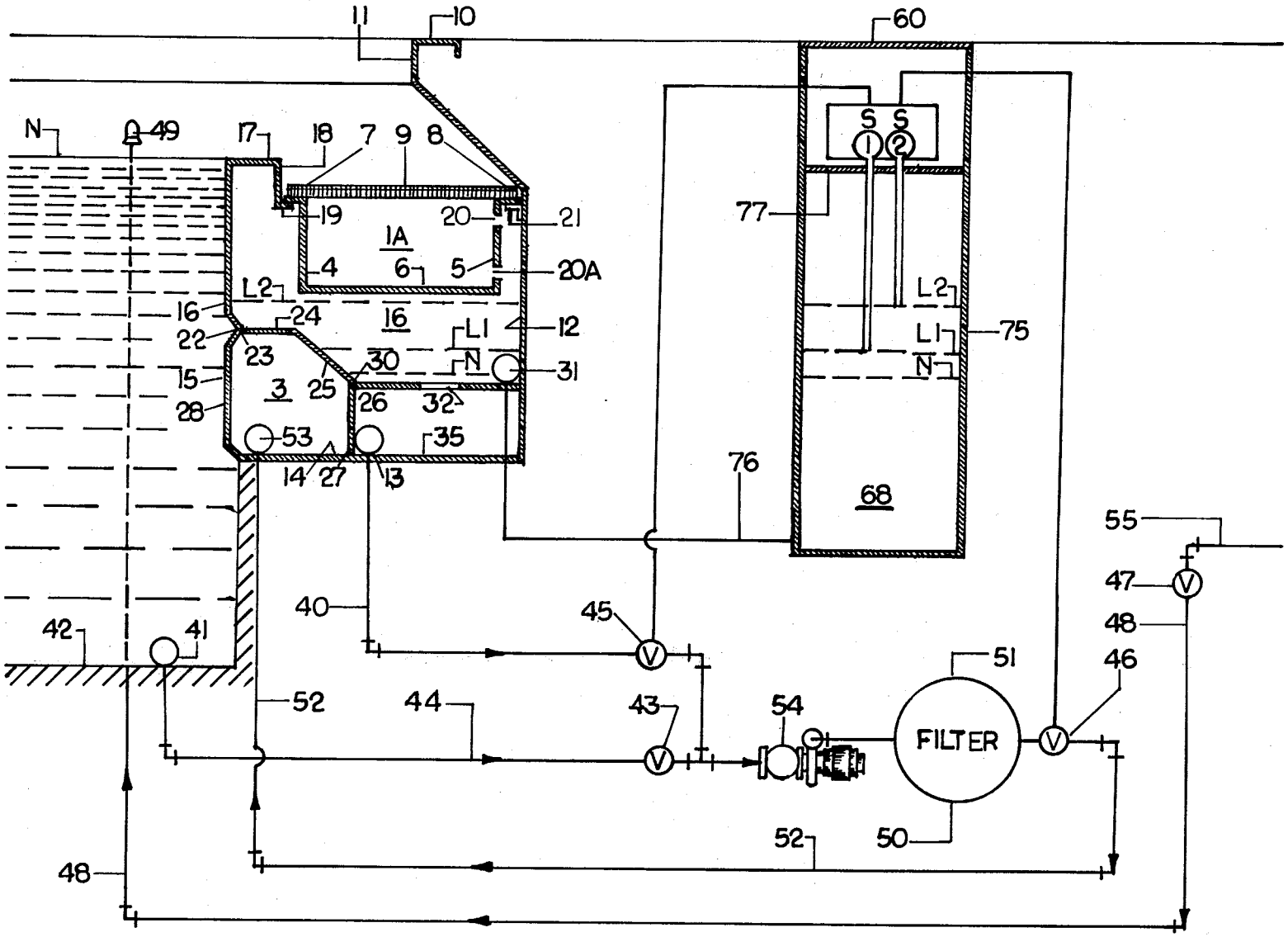
FIG. 5 is a pool water flow circuit diagram of an embodiment similar to that of FIG. 1, but with a twin gutter pool perimeter water recirculation system.

A further modification of the water flow circulation layout for the pool perimeter gutter system shown in FIG. 1 is shown in FIG. 5. The system is very similar to that of FIG. 1 and so only the differences in structure will be described.

In this case, the gutter construction includes a first gutter 1*a* having side walls 4,5 and a bottom wall 6, supported on flanges 19, 21 beneath the grille 9. Openings 20 permit water to flow by overflow from gutter 1*a* into gutter 1*b*. None of the sensors is actuated until overflow into the second gutter 1*b* occurs, but a second set of openings 20*a* ensure a sufficient flow into gutter 1*b* to maintain level N at all times, so that the suction line 40 is not starved.

There is a gutter drain line 40 leading from the second gutter 1*a* via suction conduit 35 to the suction side of pump 54, which is a part of the water recirculation system 50, and there is also a main drain 41 in the bottom 42 of the swimming pool leading via main drain line 44 to the suction side of pump 54. There is a main drain throttling valve 43 in the main drain line 44, so that this line can be closed off, or partially or fully opened, and there is also a gutter drain valve 45 in the gutter drain line 40 so that this can be closed off, or partially or fully opened. On the downstream side of filter 51 in the water purifying system there is a recirculation flow throttling valve 46, which controls recirculation flow through the return feed line 52 leading to the water feed inlet 53 in the water feed conduit 3. The valve 46 also can be partially or fully opened, or closed, increasing the recirculation flow or decreasing it, as may be required. The pump 54 maintains suction in conduit 35 and line 40, and in line 44, and circulation of water through the filter 51 and return feed line 52 to the conduit 3.

There is also a make-up water valve 47 in fluid flow connection via a line 48 to the fillspout 49 or the deck of the pool, permitting introduction of fresh water from the water supply, such as, for example, the water main supply at the pool location.

The water level sensing system of FIG. 5 is disposed in the chamber 68 of tank 75, and is connected with the gutter 1*b* via line 76. There are two sensors S1, S2, detecting two different water levels in the gutter 1*b*. The position of these sensors can be adjusted up or down on bracket mounting bar 77, so that any desired combination of water levels can be detected, and an appropriate response effected.

The first sensor S1 senses and responds to a first level L1 of water in tank 75 above the normal operating pool water level, reflected in gutter level N, with the pool quiescent and normal skimming flow provided over the top wall 17 of the pool perimeter into the gutter 1*a*, and then into gutter 1*b*. The sensor responds to this level in the tank 75 by sending an electric signal to the valve 45, and opening it further to increase suction flow via conduit 35 and line 40, and thus accommodate this increased flow.

The second sensor S2 senses a higher water level L2 in the tank 75, corresponding to the increased perimeter overflow into the gutter under light pool activity. When the water level reaches L2, there is not enough flow through the conduit 35 and line 40, and it is necessary to increase water recirculation flow. Sensor S2 responds to this condition by actuating the valve 46, and increasing recirculation flow sufficiently to accommodate the surge flow cascading over the top of 17 of the perimeter gutter into gutter 1*b*, so that the gutters 1*a*, 1*b* have adequate capacity to accommodate such flow. The recirculation system 50 is so designed as to accommodate any maximum flow that may be encountered during maximum activity in the pool.

As pool activity decreases, and gradually returns to normal, the sensors are again actuated in the same order but in reverse sequence, so that the water recirculation system responds to the now decreased circulation through the gutters.

Thus, a decrease in the water level to below level L2, sensed by sensor S2, results in a throttling back of recirculation flow throttling valve 46. When the level decreases further, to below level L1, of sensor S1, the gutter drain valve 45 is closed back to accommodate gutter drain flow down to but not below level N to maintain a flow to the pump sufficient to prevent the pump from drawing in air.

The control system of FIG. 5 like that of FIG. 1 is a water recirculating system which is controlled automatically by the swimming load. The most desirable of the various possible operating modes is selected automatically by the control system, dynamically guided by the amount of people in the pool, and their activity.

Figures 6, 6A:
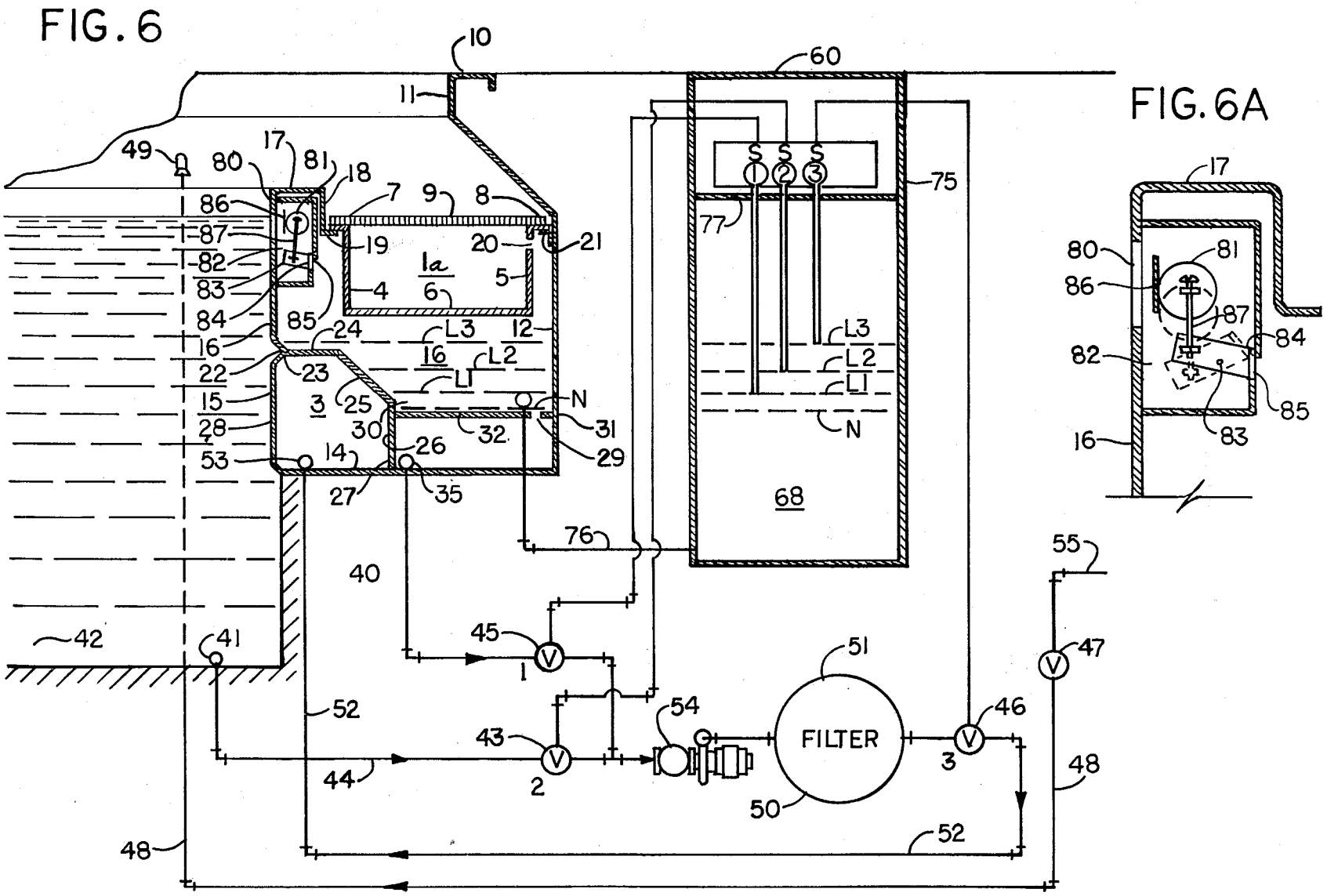
FIG. 6 is a pool water circuit diagram of an embodiment similar to that of FIG. 4, but with a twin gutter pool perimeter water recirculation system.
FIG. 6A is a detail view of a weir passage and closure of the system of FIG. 6 showing the closure in the closed position.

A further modification of the water flow circulation layout for the pool perimeter gutter system shown in FIG. 1 is shown in FIG. 6. The system is very similar to that of FIG. 5, but with a surge weir system.

The pool perimeter single gutter system shown in FIG. 6 is made in a plurality of modular units, which are fitted together on-site and bonded together by welding, soldering or brazing in the number required to form the perimeter rim of a swimming pool.

In this case, the gutter construction includes a first gutter 1*a* having side walls 4,5 and a bottom wall 6, supported on flanges 19, 21 beneath the grille 9. Openings 20 permit water to flow by overflow from gutter 1*a* into gutter 1*b*. None of the sensors is actuated until overflow in the second gutter 1*b* occurs. A sheet of stainless steel or other corrosion-resistant metal or plastic material is formed in the configuration shown, with a top coping 10, a gutter back wall 11, bent forward towards the pool in a manner to partially cover over the opening into the gutter 1*a* and then continuing to form back wall 12 of the gutter 1*b*, and the back wall 12 and the bottom wall 13 of the suction conduit 35, the bottom wall 14 and pool perimeter side wall 15 of a water feed conduit 3, the pool perimeter side wall 16 of the gutter 1*b* and the top wall 17 of the gutter 1*a*, which also serves as the top rim of the swimming pool, over which water may flow into the gutter 1*a*. The stainless steel sheet terminates in a flange 19. A second flange 21 is attached by welding or brazing to the back wall 11 of the gutter 1*b*.

A grille 9 rests on flanges 19, 21 and covers over the open top of the gutter 1, so as to prevent bathers from stepping into it, with possible injurious consequences. The grille is removable and of course can be omitted.

The pool perimeter walls 16 of the gutter 1 and 15 of the water feed conduit 3 meet in a V-notch 22. At the base 23 of the V a third sheet of stainless steel is welded, and formed so as to extend inwardly and down to define the other sidewalls 24,25,26 of the water feed conduit 3, and is welded to the bottom wall 13 of the conduit 35 at 27.

A plurality of openings 28 are provided in the notch 22 of the pool perimeter wall 15 of the water feed conduit 3, for feed of recirculating clean water to the pool. These openings can, if desired, be provided with nozzles or jets, in known manner, directing flow horizontally or downwardly into the pool.

Through the pool perimeter side wall 16 of the gutter are a number of narrow, long openings 80, approximately one-half inch below the top rim 17 of the gutter 1. As best seen in FIG. 6A, these openings lead to weir passages 82, which accommodate skimming flow from the pool, and feed it directly into the gutter 1*b*. Surge flow across the top 17 of the perimeter gutter feeds directly into the gutter 1*a*. Flaps 84 are provided across the openings 85 at the inner ends of the weir passages 82. These flaps are pivotably mounted on pivot pins 83 and linked pivotably by rods 87 to floats 81, which rise and fall on the level of water in the weir flow passages 82. At levels in the weir passages below the floats, the flaps 84 are open. At levels high enough to raise the floats, the flaps are pivoted by rods 87 clockwise on pins 83, across the openings 85, so the weirs are closed, automatically, closing off the weir passages 82. The opening and closing of the flaps can be effected by any kind of mechanism, however.

There is a wall 29 with openings 32 therethrough welded at one end 30 to the wall 26 and at the other end 31 to the wall 12, forming a suction conduit 35 to draw water from the gutter 1*b* into the water recirculation system.

There is a gutter drain overflow line connection 40 leading from the conduit 35 to the suction side of the pump 54, which is a part of the recirculation system 50, and there is also a main drain 41 in the bottom 42 of the swimming pool leading via main drain line 44 to the recirculation system. There is a main drain throttling valve 43 in the main drain line 44, so that this line can be closed off, or partially or fully opened, and there is also a gutter drain overflow valve 45 in the gutter line 40, so that this can be closed off, or partially or fully opened. On the downstream side of the filter 51 in the water purifying system there is a two-position recirculation flow throttling valve 46, which controls recirculation flow through the filter and the return feed line 52 leading to the water feed inlet 53 in the conduit 3. The valve 46 also can be partially or fully opened or closed, increasing the recirculating flow or decreasing it, as may be required. The pump 54 sucks water from the gutter via the gutter drain line 40 and from the pool via line 44, and maintains circulation of water through the water recirculation system via the filter 51 and return feed line 52 to the conduit 3.

There is also a make-up water valve 47 in fluid flow connection via a line 48 to the fillspout 49 on the deck of the pool, permitting introduction of fresh water from the water supply, such as, for example, the water main supply at the pool location, via line 55.

The water level sensing system 60 is composed of three doubleacting sensors, sensor S1 controlling opening and closing of gutter drain overflow valve 45, sensor S2 controlling opening and closing of the main drain throttling valve 43, and sensor S3 controlling opening and closing of the two-position recirculation flow throttling valve 46, as flow increasing or diminishes.

The three sensors, S1, S2, S3 detect three different water levels L1, L2 and L3 in the gutter 1*b*. These water levels are sensed not in the gutter but in gutter level chamber 68, in the gutter level tank 75 directly connected via line 76 with the gutter 1*b* at the bottom. The position of these sensors can be adjusted up or down on bracket mounting bar 77, so that any desired combination of selected water levels can be detected, and an appropriate response effected.

The first sensor S1 senses and responds to a first level L1 of water in tank 75 above the normal operating pool water level, reflected in gutter level N, with the pool quiescent and normal skimming flow provided via the weirs 80 and weir passages 82 past the floats 81 into gutter 1*b*. The sensor responds to this level in the tank 75 by sending an electric signal to the valve 45, and opening it further to increase suction flow via conduit 35 and line 40, and thus accommodate this increased flow.

The second sensor S2 senses a higher water level L2 in the tank 75, corresponding to a perimeter overflow over the top of rim into the gutter 1*a* and thence into gutter 1*b* under light pool activity. When the water level in gutter 1*b* reaches L2, there is not enough suction flow through the conduit 35 and line 40, and it is necessary to increase the proportion of water recirculation flow from the gutter 1*b*. Sensor S2 responds to this condition by actuating the valve 43, shutting it off and with it flow from the pool via main drain line 44, thus making available the total capacity of water recirculation flow sufficient to accommodate the surge flow cascading over the top of 17 of the perimeter gutter into gutter 1*a*, so that the gutters 1*a*, 1*b* have adequate capacity to accommodate such flow. The recirculation system 50 is so designed as to accommodate any maximum flow that may be encountered during maximum activity in the pool.

A further increase in pool activity will lead to an increased flow of water across the top 17 of the perimeter gutter into the gutter 1*a*. This further increases the water level in the gutter 1*b*, to the level L3, sensed by the third gutter sensor S3, and increases the burden on the water recirculation system, which requires adjustment to accommodate the increased gutter flow.

Accordingly, this sensor S3 opens the recirculation flow throttling valve 46 to the next higher open position, further increasing the rate (and therefore the volume amount) of recirculation flow through the recirculation system 50, so as to accommodate the increased flow into the gutter 1*b*, via suction line 40.

A further increase in pool activity to the maximum activity level, and/or a blocking in the filter 51, impeding flow, increases gutter level to level L4. This lifts the floats 81, a part of the skimming weir closure, which lifts the flaps 84 into position closing the weir openings 85, and thus limiting flow entering the gutter 1*b* to overflow over the rim 17 into gutter 1*a*. The line 40 and pump 54 are so designed as to accommodate any maximum gutter flow that may be encountered during maximum activity in the pool, via this route.

As pool activity decreases, and the gutter level gradually returns to level L3, the floats 81 sink, and the weirs are reopened. When level L3 is again reached, the third sensor S3 is actuated, and thereupon throttles back recirculation flow throttling valve 46, so that the water recirculation system responds to the now decreased circulation through the gutter.

When the gutter level decreases further, to the level L2, sensor S2 is actuated, and reopens valve 43, restoring main drain flow, and then at level L1, sensor S1 is actuated, and throttles back valve 45. The level then drops to normal level N, and this condition is maintained so long as the pool is quiescent, at normal pool operating level, thus ensuring adequate skimming flow during periods of quiescence.

The electric sensors S1, S2, S3 and the actuating electric control circuit are well known, conventional and commercially available. In place of electric sensors, pneumatic or pressure-operated sensors can be used, sensing a water pressure related to water level, and actuating an electric control circuit.

It is thus apparent that this sensor system in accordance with the invention senses and responds to a water level in the gutter, so as to accommodate any volume of overflow as over-rim flow into the gutter, without gutter flooding or spill back into the pool.

The necessary gutter capacity to accommodate the increased gutter flow during periods of pool activity, whether low or intense, is provided by the gutter and the suction drain flow, thus ensuring that at no time does water washed into the gutter return to the pool without having first passed through the pool cleansing and recirculation system via the filter. The response to the higher level of activity is fully automatic in all cases.

The gutter overflow control system is consequently fully automatic, whether the flow to be accommodated is increasing or decreasing, and according to whether the pool is quiescent or active.

It is thus evident that control system of FIG. 6, like that of FIG. 4, is controlled automatically by the swimming load. The most desirable of the various possible operating modes is selected automatically by the control system, dynamically guided by the amount of people in the pool, and their activity.

During quiescence (no persons in the pool) surface cleaning takes place through open surge weirs. As swimmers enter the pool causing displacement surge and waves, the gutter drain valve will open further. As the number of swimmers increases and the activity level increases, the recirculation (turnover) rate will automatically increase, improving the quality of filtration. As activity continues to increase, these weirs will automatically and positively close. As the bathers leave the pool, the recirculating rate will return to normal, and the gutter drain valve and surge weirs will return to predetermined levels, as the pool returns to its quiescent state. If after reaching quiescence the designed rate of surface cleaning is not being maintained, water can be added to the swimming pool until this rate is achieved.

Functionally, the lower of the two gutters, the second gutter 1*b*, accepts water through the surge weirs during quiescence, and continues to accept water until it reaches a predetermined level. At this level, the surge weirs automatically close, requiring all water to enter the first gutter of the perimeter overflow system by passing over the perimeter overflow system lip into the upper gutter. Water may flow from the upper first gutter directly into the lower second gutter. As the pool activity and number of swimmers decreases, the upper gutter will drain the surge weirs will open, and the system will return to its normal recirculating rate.

The system thus responds automatically to user-activated dynamic demand, to determine the operating mode, continuously and automatically for the life of the swimming pool.

Figure 7:
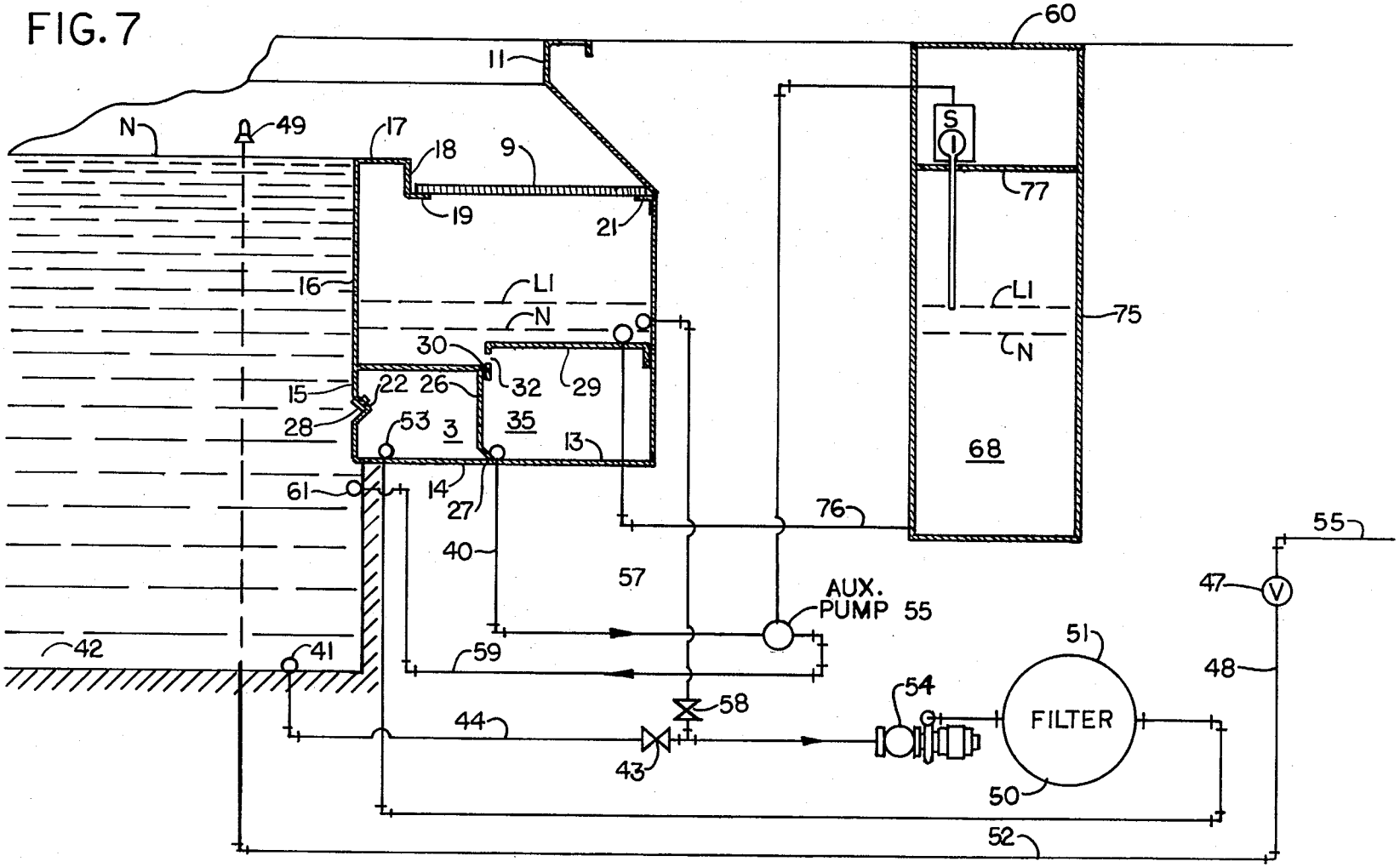
FIG. 7 is a pool water flow circuit diagram of another embodiment of single skimming perimeter gutter water recirculation system, with a separate suction gutter bypass line.

The pool perimeter single gutter system shown in FIG. 7 is made in a plurality of modular units, which are fitted together on-site and bonded together by welding, soldering or brazing in the number required to form the perimeter rim of a swimming pool. A sheet of stainless steel or other corrosion-resistant metal or plastic material is formed in the configuration shown, with a top coping 10, a gutter back wall 11, bent forward towards the pool in a manner to partially cover over the opening into the gutter 1, and then continuing to form back wall 12 of the gutter 1, and the back wall and bottom wall 13 of the suction conduit 35, the bottom wall 14 and the pool perimeter side wall 15 of a water feed conduit 3, the pool perimeter side wall 16 of the gutter 1, and the top wall 17 of the gutter 1, which also serves as the top rim of the swimming pool, over which water may flow into the gutter 1. The stainless steel sheet terminates in a flange 19. A second flange 21 is attached by welding or brazing to the back wall 11 of the gutter 1.

A grille 9 rests on flanges 19, 21 and covers over the open top of the gutter 1, so as to prevent bathers from stepping into it, with possibly injurious consequences. The grille is removable and of course can be omitted.

Both skimming flow and surge flow from the pool proceed across the top 17 of the perimeter gutter feed directly into the gutter 1.

A third sheet of stainless steel is welded to the pool perimeter wall 16 and formed so as to extend inwardly and down to define the other sidewalls 24, 26 of the water feed conduit 3, and is welded to the bottom 13 of the gutter 1 at 27.

The pool perimeter wall 15 of the water feed conduit 3 has a V-notch 22. A plurality of openings 28 are provided in the upper leg of the V-notch for feed of recirculating clean water to the pool. These openings are provided with nozzles or jets, in known manner, directing flow downwardly into the pool.

A fourth sheet of stainless steel 29 having a plurality of openings 32 extends between wall 26 of conduit 3 and wall 12 of the gutter, welded at 30 to wall 26, and at 31 to wall 12, defining a suction conduit 35. There is also a main drain 41 in the bottom 42 of the swimming pool leading via main drain line 44 to the pump 54 and water recirculation system 50. There is a main drain throttling valve 43 in the main drain line 44, so that this line can be closed off or partially or fully opened.

There is a main gutter drain line 57 with a gutter drain valve 58 which is normally partially or fully opened and leads normal gutter drain flow into line 44 beyond valve 43 and to the water recirculation system 50. There is also a secondary suction gutter drain line connection 40 leading from the conduit 35 to the suction side of pump 55, and then directly back to the pool via line 59 to water feed inlet 61, bypassing the filter 51 and the water recirculation system 50. The pump 55 sucks water from the gutter 1 via openings 32 and conduit 35 and line 40 under direction of the sensor S, returning it directly to the pool via line 59 to water feed inlet 61, while pump 54 maintains normal recirculation of water from lines 44 and 57, through the filter 51 and return feed line 52 to the conduit 3.

There is also a make-up water valve 47 in fluid flow connection via a line 48 to the fillspout 49 or the deck of the pool, permitting introduction of fresh water from the water supply, such as, for example, the water main supply at the pool location, via line 55.

The water level sensing system 60 is composed of one sensor S which is double-acting, detecting one water level L1 in the gutter 1. This water level is sensed not in the gutter but in gutter level chamber 68, in the gutter level tank 75 in direct fluid flow connection by the line 76 to the gutter 1.

The normal operating pool water level corresponds to gutter level N, with the pool quiescent and normal skimming flow provided over the top wall 17 of the pool perimeter into the gutter 1.

The sensor S senses and responds to a level L1 of water in tank 75 above the normal operating pool water level corresponding to an increased perimeter overflow over the top of rim into the gutter 1, under light pool activity. When the water level in gutter **1*b* reaches level L1, there is not enough flow through the conduit 57 to drain the gutter, and it is necessary to increase the water recirculation flow from the gutter. Sensor S responds to this condition by actuating the pump 55, to start suction flow via conduit 35 and line 40, and thus accommodate this increased flow over the rim 17 into the gutter 1. The bypass loop suction flow recirculation system via lines 40, 55, is so designed as to accommodate any maximum flow over the rim 17** that may be encountered during maximum activity in the pool.

As pool activity decreases, gutter level falls, and when level L1 is again reached, the sensor S is actuated, and thereupon shuts off the pump 55, stopping suction flow from the gutter via the bypass circuit 40, 55. The level can then drop back to normal level N, and this condition is maintained with gutter drain flow only via line 57 so long as the pool is quiescent, at normal pool operating level, with adequate skimming flow during periods of quiescence.

The electric sensor S and the actuating electric control circuit are well known, conventional and commercially available. In place of electric sensors, pneumatic or pressure-operated sensors can be used, sensing a water pressure related to water level, and actuating an electric control circuit.

It is thus apparent that this single sensor system in accordance with the invention senses and responds to a water level in the gutter, so as to accommodate any volume of overflow as over-rim flow into the gutter, without gutter flooding or spill back into the pool.

The necessary gutter capacity to accommodate the increased gutter flow during periods of pool activity, whether low or intense, is provided by the gutter and the suction drain flow, thus ensuring that at no time does water washed back from the gutter into the pool over the top rim 17. The response to the higher level of activity is fully automatic in all cases.

The gutter overflow control system is consequently fully automatic, whether the flow to be accommodated is increasing or decreasing, and according to whether the pool is quiescent or active.

The perimeter gutters and weirs shown in FIGS. 1 to 7 are made of stainless steel, but it will, of course, be understood that other metals can be used, such as galvanized iron and steel, and aluminum, as well as anodized aluminum. Whatever the metallic material, its surface should be treated so as to render it corrosion-resistant, as by plating, galvanizing, anodizing, porcelain-enamel coating, or painting. It is also possible to form the perimeter gutter and/or the weir of plastic material, either in whole or in part. There are plastics now available which are sufficiently strong to withstand the wear and tear of a perimeter gutter system, including, for example, acrylonitrile-butadiene-styrene resin, polycarbonate resin, polytetrafluoroethylene, polyvinyl chloride, polyvinylidene chloride, polyesters, polypropylene, polyamides, and synthetic rubbers such as polyisoprene, polybutadiene, butadiene-styrene copolymers, and butadiene-isoprene copolymers.

The preferred construction is from a sheet or several sheets of metallic or plastic material, which are formed into the desired configuration, as is seen in the cross-sectional drawings. It is usually preferred that the coping portion at the top rear of the perimeter gutter extend at least partially, and preferably wholly, across an open gutter trough, so as to prevent people from stepping or falling into the gutter. Such can also be prevented by covering the gutter with a grating or grille of metal or plastic, the same or different material from the gutter.

The use of modular units such as are shown in FIGS. 1 to 7 is preferred, because this permits mass production of the gutter and weir system at a point remote from the swimming pool, with easy and inexpensive transportation from that point to swimming pool construction sites anywhere in the world. The modular units can then be assembled on-site to form any type or configuration of swimming pool, and any desired weir arrangement. The modular units can be made in straight sections for rectangular or other straight-sided pool shapes, while curved sections can be made for pear-shaped, elliptical, circular, or other curved-side pool configurations.

The modular units can be fitted together by welding, soldering or brazing, in the case of metal units; by bonding, using various types of adhesives, in the case of metal or plastic units; or by heat-sealing, ultrasonic welding, or heat-bonding, in the case of thermoplastic plastic units. Plastic units which are not fully heat-cured can be bonded and then cured in situ to form a permanent bond on-site, in the course of construction of the pool.

The perimeter gutter and weir system of the invention can be used completely around the perimeter of a pool, or only partially around the pool perimeter, as desired. The most uniform skimming action and gutter action is, of course, obtained when the entire perimeter of the pool is provided with such a gutter and weir.

While construction of the gutter and weir in the form of modular units has been described, it will also be appreciated from FIGS. 1 to 7 that the gutter and weir system can be formed on-site in the configurations shown using concrete or plastic material, and can form an integral part of the pool wall, by casting or pouring into suitable frames, so that the material can harden and set in the desired pool and skimmer outlet shape. The construction of the gutter system is sufficiently simple so that this type of technique can be employed with good results. Since this requires more hand-work, however, and is therefore a more costly method of construction, it would not usually be preferred, particularly in the case of large pools, where construction costs may be too high to permit the luxury of a handmade gutter system on the pool site.

The gutter and weir system can also be made from bricks or tiles, which are built up in the desired configuration. These can be the usual types of materials, preferably with a ceramic facing, so that it is leak-proof, with the tiles being bonded together with water-resistance adhesive or cement.

The swimming pool can be equipped with any type of water filtration and cleaning recirculation system. The gutters usually feed water therein to such systems by gravity. However, recirculation pumps can be provided, and the gutters can also be provided with jet water inlets to direct a driving flow of water along the gutter, to flush out the gutters, and to drive water along the gutter towards the water recirculation system. Such jet water inlets are described in U.S. Pat. No. 3,932,397 to Ogden, dated Apr. 13, 1960.

Other variations and modifications of the invention will be apparent to those skilled in the art.

Having regard to the foregoing disclosure, the following is claimed as inventive and patentable embodiments thereof:

1. An automated skimming flow perimeter gutter flow control system for swimming pools comprising, in combination, a water cleaning and recirculation system receiving water from the pool, cleaning it, and returning it to the pool; a gutter conduit for disposition about the perimeter of a swimming pool, receiving overflow across a top edge thereof and adapted to carry water at a level below a predetermined level in the swimming pool; a drain line connecting the gutter conduit with the water recirculation system; suction means in series flow connection with the gutter conduit and drain line for positive withdrawal under suction of water from the gutter conduit and feed of such water to the water recirculation system for return to the pool; at least one of (a) means for controlling water recirculation capacity to accommodate any selected flow of water from the gutter to the water recirculation system; and (b) means for controlling suction flow from the gutter to the water recirculation system; and at least one water level-responsive sensor sensing and directly responding to the level of water in the gutter conduit by adjusting at least one of the means controlling water recirculation capacity to accommodate flow from the gutter and the means for controlling suction flow, to increase gutter drain flow sufficiently to prevent gutter water flooding back from the gutter to the pool.

2. An automated skimming flow perimeter gutter control system for swimming pools in accordance with claim 1, comprising a second gutter receiving skimming flow and also providing additional gutter capacity for extraordinary gutter flow, including relief flow from the first gutter in the event of considerable activity in the pool.

3. An automated skimming flow perimeter gutter control system for swimming pools in accordance with claim 1, comprising skimming means affording skimming flow across a top edge thereof at the perimeter of the swimming pool.

4. An automated skimming flow perimeter gutter control system for swimming pools in accordance with claim 1, wherein the sensor adjusts the means for controlling suction flow from the gutter, to increase gutter drain flow.

5. An automated skimming flow perimeter gutter control system for swimming pools in accordance with claim 1, wherein the sensor adjusts the means controlling water recirculation capacity to accommodate flow from the gutter.

6. An automated skimming flow perimeter gutter control system for swimming pools in accordance with claim 1, comprising at least two sensors, of which one adjusts the means controlling suction flow from the gutter and the other adjusts the means controlling water recirculation capacity, to increase gutter drain flow.

7. An automated skimming flow perimeter gutter control system for swimming pools in accordance with claim 1 in which the means controlling water recirculation capacity and the means controlling suction flow are each valves.

8. An automated skimming flow perimeter gutter control system for swimming pools in accordance with claim 1, wherein one of the means controlling water recirculation capacity and the means controlling suction flow from the gutter comprises a bypass line bypassing at least part of the water recirculation system, flow through which bypass line is controlled by a valve or pump.

9. An automated skimming flow perimeter gutter control system for swimming pools in accordance with claim 1 in which the means for controlling water recirculation capacity and the means for controlling suction flow are combined in the same component.

10. An automated skimming flow perimeter gutter control system for swimming pools in accordance with claim 1 in which the means for controlling suction flow to increase gutter drain flow is a throttling valve in the drain line between the gutter and the water recirculation system, which is normally set at less than full suction flow capacity for that line, and suction flow is increased by opening the valve further, controlled by way of the water-level responsive sensor.

11. An automated skimming flow perimeter gutter control system for swimming pools in accordance with claim 1 in which the means for controlling water recirculation capacity is a throttling valve, which is set at a position that is less than fully open for normal recirculation flow, and then opened further to increase water recirculation flow, controlled by the water-level responsive sensor.

12. An automated skimming flow perimeter gutter control system for swimming pools in accordance with claim 1, comprising a pool drain line also feeding into the water recirculation system, and a throttling valve in this line the water-level responsive sensor being in operative connection with this valve.

13. An automated skimming flow perimeter gutter control system for swimming pools in accordance with claim 1, comprising two gutter drain lines, one leading to the water recirculation system before any filter, for normal use, and one for use only in times of high gutter flow, bypassing any filter and returning the gutter drain flow directly to the pool and comprising a pump to withdraw suction gutter flow from the gutter, and recirculate it to the pool, and a water level-responsive sensor controlling operation of the pump according to a selected high gutter water level.

14. An automated skimming flow perimeter gutter control system for swimming pools in accordance with claim 1 in which the gutter includes at least one surge weir arranged in a weir passage, and a mechanism closing off the surge weirs, arresting skimming flow through the weirs, and retaining the water in the pool at a higher level, but allowing skimming flow and/or flow surges to proceed across the top rim of the pool perimeter, into the gutter.

15. An automated skimming flow perimeter gutter control system for swimming pools in accordance with claim 1 in which the mechanism is a float riding on gutter water level and responsive to a predetermined level thereof to close the weirs.

16. An automated skimming flow perimeter gutter control system for swimming pools in accordance with claim 1, comprising an overflow sensor responsive to a gutter water level corresponding to a selected low or high activity pool condition above the normal surge weir skimming flow level, and actuating the mechanism closing off the weirs.

17. An automated skimming flow perimeter gutter control system for swimming pools in accordance with claim 1, comprising, in combination, a first drain line connecting the pool to the water recirculation system for water feed from the pool for cleaning; the second drain line being the line connecting the gutter conduit with the water recirculation system; pump means in series flow connection with the gutter conduit and second drain line for positive withdrawal of water from the gutter conduit and water feed from the gutter for cleaning; a first drain valve in the first drain line which when open allows water from the pool to flow to the water recirculation system, and when closed stops such flow; a second drain valve in the second drain line which when open allows water from the gutter to flow to the water recirculation system and when closed stops such flow; means in flow connection with the first and second drain lines and the water recirculation system, receiving pool water via each drain line, blending the pool waters, and flowing the blended waters to the water recirculation system; and at least one water level-responsive sensor sensing and directly responding to the level of water in the gutter conduit and adjusting the first drain valve to reduce water recirculation flow from the pool and thereby to increase water recirculation system capacity for flow from the gutter, and prevent gutter water flooding back from the gutter to the pool.

18. An automated skimming flow perimeter gutter control system for swimming pools in accordance with claim 17, comprising a second gutter receiving skimming flow and also providing additional gutter capacity for extraordinary gutter flow, including relief flow from the first gutter in the event of considerable activity in the pool.

19. An automated skimming flow perimeter gutter control system for swimming pools in accordance with claim 17, comprising skimming means affording skimming flow across a top edge thereof at the perimeter of the swimming pool.

20. An automated skimming flow perimeter gutter control system for swimming pools in accordance with claim 17, wherein the sensor senses a predetermined water level in the gutter overflow at which overflow exceeds normal recirculation flow combined from the first and second lines and increases the opening at the second drain valve, so that the gutter drain suction flow withdraws more overflow from the gutter.

21. An automated skimming flow perimeter gutter control system for swimming pools in accordance with claim 17, wherein the means for withdrawing water from the gutter conduit comprises a pump connected with its suction side to the gutter conduit.

22. An automated skimming flow perimeter gutter control system for swimming pools in accordance with claim 17, wherein the water recirculation system includes a recirculating flow throttling valve, movable between open and closed positions and controlling recirculating flow to and from the pool; and the sensor senses a predetermined water level in the gutter overflow at which the capacity of the recirculation system is exceeded, and adjusts the throttling valve, increasing the amount of water drawn through the recirculation system to accommodate this excess gutter overflow.

23. An automated skimming flow perimeter gutter control system for swimming pools in accordance with claim 17, wherein the water recirculating system includes, in flow sequence, a pump, a filter, and a line bypassing the filter, and a bypass valve movable between open and closed positions, controlling flow through the bypass line; and the sensor means opens the bypass valve, thereby opening the line bypassing the filter.

24. An automated skimming flow perimeter gutter control system for swimming pools in accordance with claim 17, comprising a recirculating flow throttling control valve on the return line of the recirculation system; a first sensor that senses a predetermined water level in the gutter overflow at which overflow exceeds normal recirculation flow combined from drains and opens the second drain valve further, so that the recirculation system receives more pool water flowing from the gutter; and a second sensor that senses a predetermined water level in the gutter overflow at which the capacity of the recirculation system is exceeded, and adjusts the throttling valve to increase the amount of water drawn through the recirculation system, to accommodate this excess flow.

25. An automated skimming flow perimeter gutter control system for swimming pools in accordance with claim 1, comprising a second gutter conduit, and an overflow connection between the first and second gutters, so that water at and over the level of the overflow connection flows from the first gutter to the second gutter.

26. An automated skimming flow perimeter gutter control system in accordance with claim 25, in which the first gutter conduit is an open trough.

27. An automated skimming flow perimeter gutter control system in accordance with claim 25, in which the fluid flow connection between the first and second gutter conduits is in the form of a plurality of slots at the predetermined maximum level of water in the first gutter conduit.

28. An automated skimming flow perimeter gutter control system in accordance with claim 25, in which a water-feed conduit is provided for feed of fresh water into the pool.

29. An automated skimming flow perimeter gutter control system in accordance with claim 28, in which the water feed conduit is disposed beside the first gutter conduit.

30. An automated skimming flow perimeter gutter control system in accordance with claim 28, in which the water feed conduit is disposed within the first gutter conduit.

31. An automated skimming flow perimeter gutter control system in accordance with claim 28, in which the water feed conduit is disposed within the second gutter conduit.

32. An automated skimming flow perimeter gutter control system in accordance with claim 25, in which the two gutter conduits are separated by a common wall, and the fluid flow connection between the two gutters is provided by a plurality of openings through the wall.

33. An automated skimming flow perimeter gutter control system in accordance with claim 25, comprising at least one jet water feed inlet in either the first or the second gutter conduit, or both, for driving water and debris along the gutter conduit.

34. An automated skimming flow perimeter gutter control system in accordance with claim 25, in the form of a modular wall unit adapted to be assembled end-to-end with other such units to form the perimeter gutter wall of a swimming pool.

35. An automated skimming flow perimeter gutter control system in accordance with claim 25, in which the second gutter is within the pool side retaining wall of the first gutter conduit.

36. An automated skimming flow perimeter gutter control system in accordance with claim 25, in which the second gutter is within an external peripheral wall of the first gutter conduit.

37. A swimming pool comprising side walls and a bottom adapted to retain water therewithin, and, extending about the upper perimeter of at least a portion of one side wall thereof, an automated skimming flow perimeter gutter control system according to claim 1.

38. A swimming pool in accordance with claim 37 in which the perimeter skimming gutter comprises a second gutter receiving skimming flow and also providing additional gutter capacity for extraordinary gutter flow, including relief flow from the first gutter in the event of considerable activity in the pool.

39. A swimming pool in accordance with claim 37 wherein the means for withdrawal of water from the gutter comprises a pump connected with its suction side to the gutter conduit.

40. A swimming pool in accordance with claim 37, comprising skimming means affording skimming flow across a top edge thereof at the perimeter of the swimming pool.

41. A swimming pool in accordance with claim 37, wherein the sensor adjusts the means for controlling suction flow from the gutter, to increase gutter drain flow.

42. A swimming pool in accordance with claim 37, wherein the sensor adjusts the means controlling water recirculation capacity to accommodate flow from the gutter.

43. A swimming pool in accordance with claim 37, comprising at least two sensors, of which one adjusts the means controlling suction flow from the gutter and the other adjusts the means controlling water recirculation capacity, to increase gutter drain flow.

44. A swimming pool in accordance with claim 37, in which the means controlling water recirculation capacity and the means controlling suction flow are each valves.

45. A swimming pool in accordance with claim 37, wherein one of the means controlling water recirculation capacity and the means controlling suction flow from the gutter comprises a bypass line bypassing at least part of the water recirculation system, flow through which bypass line is controlled by a valve or pump.

46. A swimming pool in accordance with claim 37, in which the means for controlling water recirculation capacity and the means for controlling suction flow are combined in the same component.

47. A swimming pool in accordance with claim 37, in which the means for controlling suction flow to increase gutter drain flow is a throttling valve in the drain line between the gutter and the water recirculation system, which is normally set at less than full suction flow capacity for that line, and suction flow is increased by opening the valve further, controlled by way of the water-level responsive sensor.

48. A swimming pool in accordance with claim 37, in which the means for controlling water recirculating capacity is a throttling valve, which is set at a position that is less than fully open for normal recirculation flow, and then opened further to increase water recirculation flow, controlled by the water-level responsive sensor.

49. A swimming pool in accordance with claim 37, comprising a pool drain line also feeding into the water recirculation system, and a throttling valve in this line, the water-level responsive sensor being in operative connection with this valve.

50. A swimming pool in accordance with claim 37, comprising two gutter drain lines, one leading to the water recirculation system before any filter, for normal use, and one for use only in times of high gutter flow, bypassing any filter and returning the gutter drain flow directly to the pool via the water recirculation system return water feed line, and comprising a pump to withdraw suction gutter flow from the gutter, and recirculate it to the pool, and a water level-responsive sensor controlling operation of the pump according to a selected high gutter water level.

51. A swimming pool in accordance with claim 37, in which the gutter includes at least one surge weir arranged in a weir passage, and a mechanism closing off the surge weirs, arresting skimming flow through the weirs, and retaining the water in the pool at a higher level, but allowing skimming flow and/or flow surges to proceed across the top rim of the pool perimeter, into the gutter.

52. A swimming pool in accordance with claim 51, in which the mechanism is a float riding on gutter water level and responsive to a predetermined level thereof to close the weirs.

53. A swimming pool in accordance with claim 37, comprising, in combination, a second gutter conduit for disposition about the perimeter of a swimming pool, and adapted to carry water at a level below a predetermined level of water in the swimming pool; a retaining wall on the pool side of the gutter conduit, over the top of which wall water may flow from the pool into the first gutter conduit; the top of the wall being placed at a height to maintain a predetermined water level in the pool, to provide a skimming flow of water at such predetermined water level in the pool, and to allow excessive flows, wave actions and surges to flow over the top of the wall into the first gutter conduit; and a third drain line fluid flow interconnection between the first and second gutters.

54. A swimming pool in accordance with claim 53 in which the first gutter conduit is an open trough.

55. A swimming pool in accordance with claim 53 having a fluid flow connection between the first and second gutter conduits in the form of a plurality of slots at the predetermined maximum level of water in the first gutter conduit.

56. A swimming pool in accordance with claim 53 in which a water-feed conduit is provided for feed of fresh water into the pool.

57. A swimming pool in accordance with claim 56 in which the water-feed conduit is disposed beside the first gutter conduit.

58. A swimming pool in accordance with claim 56 in which the water-feed conduit is disposed within the first gutter conduit.

59. A swimming pool in accordance with claim 56 in which the water-feed conduit is disposed within the second gutter conduit.

60. A swimming pool in accordance with claim 53 in which the two gutter conduits are separated by a common wall, and the fluid flow connection between the two gutters is provided by a plurality of openings through the wall.

61. A swimming pool in accordance with claim 53 comprising at least one jet water feed inlet in either the first or the second gutter conduit, or both, for driving water and debris along the gutter conduit.

62. A swimming pool in accordance with claim 53 in the form of a modular wall unit adapted to be assembled end-to-end with other such units to form the perimeter gutter wall of a swimming pool.

63. A swimming pool in accordance with claim 53 in which the second gutter is within the pool side retaining wall of the first gutter conduit.

64. A swimming pool in accordance with claim 53 in which the second gutter is within an external peripheral wall of the first gutter conduit.

* * * * *